US010451376B2

(12) United States Patent
Schulz et al.

(10) Patent No.: US 10,451,376 B2
(45) Date of Patent: Oct. 22, 2019

(54) FIREARM SIMULATORS

(71) Applicants: Kurt S. Schulz, Cincinnati, OH (US); Michael Z. Bac, Huntley, IL (US)

(72) Inventors: Kurt S. Schulz, Cincinnati, OH (US); Michael Z. Bac, Huntley, IL (US)

( * ) Notice: Subject to any disclaimer, the term of this patent is extended or adjusted under 35 U.S.C. 154(b) by 641 days.

(21) Appl. No.: 14/969,842

(22) Filed: Dec. 15, 2015

(65) Prior Publication Data

US 2016/0169608 A1 Jun. 16, 2016

Related U.S. Application Data

(60) Provisional application No. 62/092,439, filed on Dec. 16, 2014, provisional application No. 62/134,728, filed on Mar. 18, 2015.

(51) Int. Cl.
*F41A 33/02* (2006.01)

(52) U.S. Cl.
CPC ..... *F41A 33/02* (2013.01)

(58) Field of Classification Search
CPC ..... F41A 33/00; F41A 33/02; F41A 33/04; F41A 33/06; F41A 33/08; F41G 3/26
See application file for complete search history.

(56) References Cited

U.S. PATENT DOCUMENTS

| | | | |
|---|---|---|---|
| 3,792,535 | A | 2/1974 | Marshall et al. |
| 4,086,711 | A | 5/1978 | Gammarino et al. |
| 4,102,059 | A | 7/1978 | Kimble et al. |
| 4,171,811 | A | 10/1979 | Meyer et al. |
| 4,205,589 | A | 6/1980 | Engler et al. |
| 4,352,665 | A | 10/1982 | Kimble et al. |
| 4,545,583 | A | 10/1985 | Pearman et al. |
| 4,640,514 | A | 2/1987 | Myllyla et al. |
| 4,695,256 | A | 9/1987 | Eichweber |

(Continued)

FOREIGN PATENT DOCUMENTS

EP 0806621 A1 12/1997

OTHER PUBLICATIONS

Nilsson, Rolf & Saltzstein, Bill, Bluetooth Low Energy vs. Classic Bluetooth: Choose the Best Wireless Technology for Your Application, http://www.medicalelectronicdesign.com/print/1654, published Jun. 8, 2012 (accessed Jun. 27, 2014).

*Primary Examiner* — Timothy A Musselman
(74) *Attorney, Agent, or Firm* — Dinsmore & Shohl LLP

(57) ABSTRACT

Firearm simulators are disclosed. In embodiments, a firearm simulator includes a processor, a memory module, a trigger unit that outputs a trigger output signal, a magazine sensor that outputs a magazine sensor output signal, an optoelectronic output device, an optoelectronic sensor, and a wireless communication device. In embodiments, the firearm simulator determines whether a trigger prep event has occurred, determines whether a trigger break event has occurred, and transmits the trigger prep event and the trigger break event with the wireless communication device. In embodiments, the optoelectronic output device is activated when a trigger break event has occurred and a simulated round is available to be fired. In embodiments, a firearm simulator wirelessly transmits information, such as magazine insertion events, magazine ejection events, trigger break events, and trigger prep event to a computing device that displays information pertaining to the received information.

18 Claims, 17 Drawing Sheets

(56) References Cited

U.S. PATENT DOCUMENTS 4,854,595 A 8/1989 Eichweber
4,923,402 A 5/1990 Marshall et al.
5,005,307 A 4/1991 Home et al.
5,194,006 A 3/1993 Zaenglein, Jr.
5,215,462 A 6/1993 Lewis et al.
5,281,142 A 1/1994 Zaenglein, Jr.
5,316,479 A 5/1994 Wong et al.
5,591,032 A 1/1997 Powell et al.
5,716,216 A 2/1998 O'Loughlin et al.
5,720,664 A 2/1998 Brubacher
5,823,779 A 10/1998 Muehle et al.
5,842,300 A 12/1998 Cheshelski et al.
5,896,691 A 4/1999 Kaminski et al.
5,953,844 A 9/1999 Harling et al.
6,068,484 A 5/2000 O'Loughlin et al.
6,171,190 B1 1/2001 Thanasack
6,237,271 B1 5/2001 Kaminski
6,315,568 B1 11/2001 Hull et al.
6,321,478 B1 11/2001 Klebes
6,322,365 B1 11/2001 Shechter et al.
6,572,375 B2 * 6/2003 Shechter ..... F41A 21/26 42/114
6,575,753 B2 6/2003 Rosa et al.
6,616,452 B2 * 9/2003 Clark ..... F41A 33/02 434/19
6,935,864 B2 8/2005 Shechter et al.
6,966,775 B1 11/2005 Kendir et al.
7,291,014 B2 11/2007 Chung et al.
7,329,127 B2 2/2008 Kendir et al.
8,439,720 B2 * 5/2013 Inoue ..... A63F 9/0291 434/11
8,602,784 B2 * 12/2013 Dvorak ..... F41A 33/02 434/11
8,646,201 B2 2/2014 Hughes et al.
8,678,824 B2 3/2014 Carter
8,734,156 B2 5/2014 Uhr
2002/0009694 A1 1/2002 Rosa
2002/0010021 A1 1/2002 McCauley
2002/0137567 A1 9/2002 Cheng
2003/0122655 A1 7/2003 Hum et al.
2004/0121292 A1 6/2004 Chung et al.
2007/0190495 A1 8/2007 Kendir et al.
2008/0131848 A1 * 6/2008 Wilson ..... F41A 9/61 434/24
2010/0201620 A1 8/2010 Sargent
2011/0207088 A1 8/2011 Uhr
2012/0015332 A1 1/2012 Stutz
2012/0141957 A1 * 6/2012 Miller ..... F41A 33/02 434/16
2012/0297654 A1 11/2012 Williams et al.
2013/0203019 A1 * 8/2013 Nolen ..... F41G 3/26 434/16
2013/0273504 A1 10/2013 Carter
2013/0316308 A1 * 11/2013 Monti ..... F41A 33/06 434/16
2013/0337415 A1 12/2013 Huet
2014/0065577 A1 * 3/2014 Quinlan ..... F41A 33/06 434/18

* cited by examiner

FIREARM SIMULATORS

CROSS-REFERENCE TO RELATED APPLICATIONS

This application claims the benefit of U.S. Provisional Application No. 62/092,439, filed Dec. 16, 2014 and U.S. Provisional Application No. 62/134,728, filed Mar. 18, 2015.

TECHNICAL FIELD

The present specification relates to firearm simulators.

BACKGROUND

Firearm simulators may be used for handling and simulating the "firing" of a firearm without live ammunition. Such firearm simulators are widely recognized as an effective means for improving firearm handling and shooting skills.

Accordingly, there is a need for firearm simulators.

SUMMARY

In one embodiment, a firearm simulator includes a processor, a memory module communicatively coupled to the processor, a trigger unit communicatively coupled to the processor, an optoelectronic output device communicatively coupled to the processor, and machine readable instructions stored in the memory module. The trigger unit outputs a trigger output signal. The optoelectronic output device outputs light when activated. When executed by the processor, the machine readable instructions cause the firearm simulator to determine whether a trigger break event has occurred based on the trigger output signal, determine whether a simulated round is available to be fired, activate the optoelectronic output device when the trigger break event has occurred and the simulated round is available to be fired, and maintain the optoelectronic output device in a deactivated state when the trigger break event has occurred and the simulated round is not available to be fired.

In another embodiment, a firearm simulator includes a processor, a memory module communicatively coupled to the processor, a trigger unit communicatively coupled to the processor, a wireless communication device communicatively coupled to the processor, and machine readable instructions stored in the memory module. The trigger unit outputs a trigger output signal. When executed by the processor, the machine readable instructions cause the firearm simulator to determine whether a trigger prep event has occurred based on the trigger output signal, transmit the trigger prep event with the wireless communication device when the trigger prep event is determined to have occurred, determine whether a trigger break event has occurred based on the trigger output signal, and transmit the trigger break event with the wireless communication device when the trigger break event is determined to have occurred.

In yet another embodiment, a firearm simulator includes a magazine including a magnet, a firearm frame including a magazine well for receiving the magazine, a magnetic field sensor positioned proximate the magazine well, a processor, a memory module communicatively coupled to the processor, and machine readable instructions stored in the memory module. The magnetic field sensor outputs a magnetic field sensor output signal. When executed by the processor, the machine readable instructions cause the firearm simulator to determine that a magazine has been inserted into the magazine well based on the magnetic field sensor output, and determine that a magazine has been ejected from the magazine well based on the magnetic field sensor output.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Referring generally to the figures, embodiments described herein are directed to firearm simulators that may be handled and manipulated by a user of the firearm simulator to simulate the firing of a firearm without the need for live ammunition. In embodiments, a firearm simulator may include a processor, a memory module, a trigger unit that outputs a trigger output signal, a magazine sensor that outputs a magazine sensor output signal, an optoelectronic output device, an optoelectronic sensor, and a wireless communication device. In embodiments, the firearm simulator may include a magnetic field sensor positioned proximate a magazine well of a firearm frame, and may determine whether a magazine has been inserted or ejected from the magazine well based on a magnetic field sensor output provided by the magnetic field sensor. In embodiments, the optoelectronic output device may be activated when a trigger break event has occurred and a simulated round is available to be fired. In embodiments, the firearm simulator may determine that a target hit event has occurred based on an ambient light value (determined based on an optoelectronic sensor output signal when the optoelectronic output device is in a deactivated state) and a reflected light value (determined based on the optoelectronic sensor output signal when the optoelectronic output device is activated). In embodiments, the firearm simulator determines whether a trigger prep event has occurred, determines whether a trigger break event has occurred, and transmits the trigger prep event and the trigger break event with the wireless communication device. In embodiments, the firearm simulator determines whether a magazine insertion event has occurred, determines whether a magazine ejection event has occurred, and transmits the magazine insertion event and the magazine ejection event with the wireless communication device. In embodiments, a firearm simulator wirelessly transmits information, such as magazine insertion events, magazine ejection events, trigger break events, trigger prep events, and target hit and target miss events to a computing device that displays information pertaining to the received information on a display. Embodiments also include a kit of parts for retrofitting a firearm simulator and a method of modifying a firearm simulator.

Figure 14:
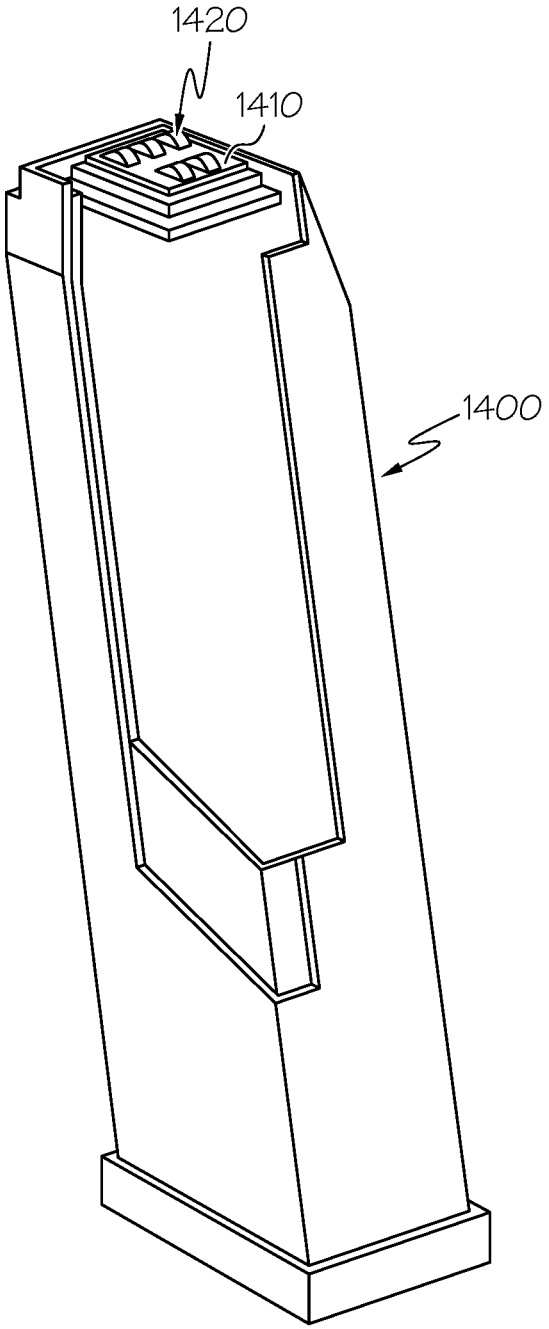
FIG. 14 schematically depicts a magazine including a magazine head connector, according to one or more embodiments shown and described herein.
Figure 15:
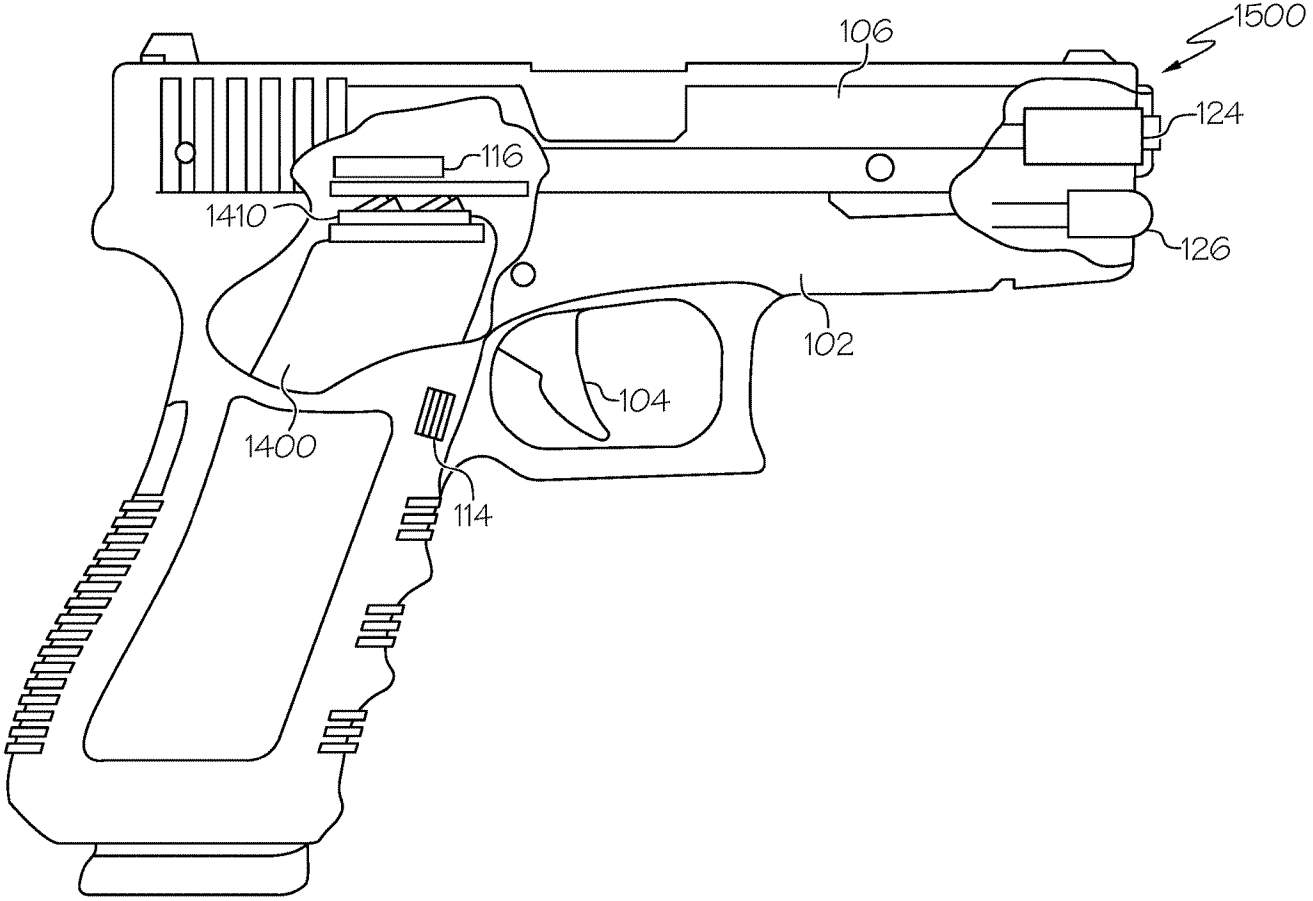
FIG. 15 schematically depicts a firearm simulator including the magazine of FIG. 14, according to one or more embodiments shown and described herein.
Figure 16:
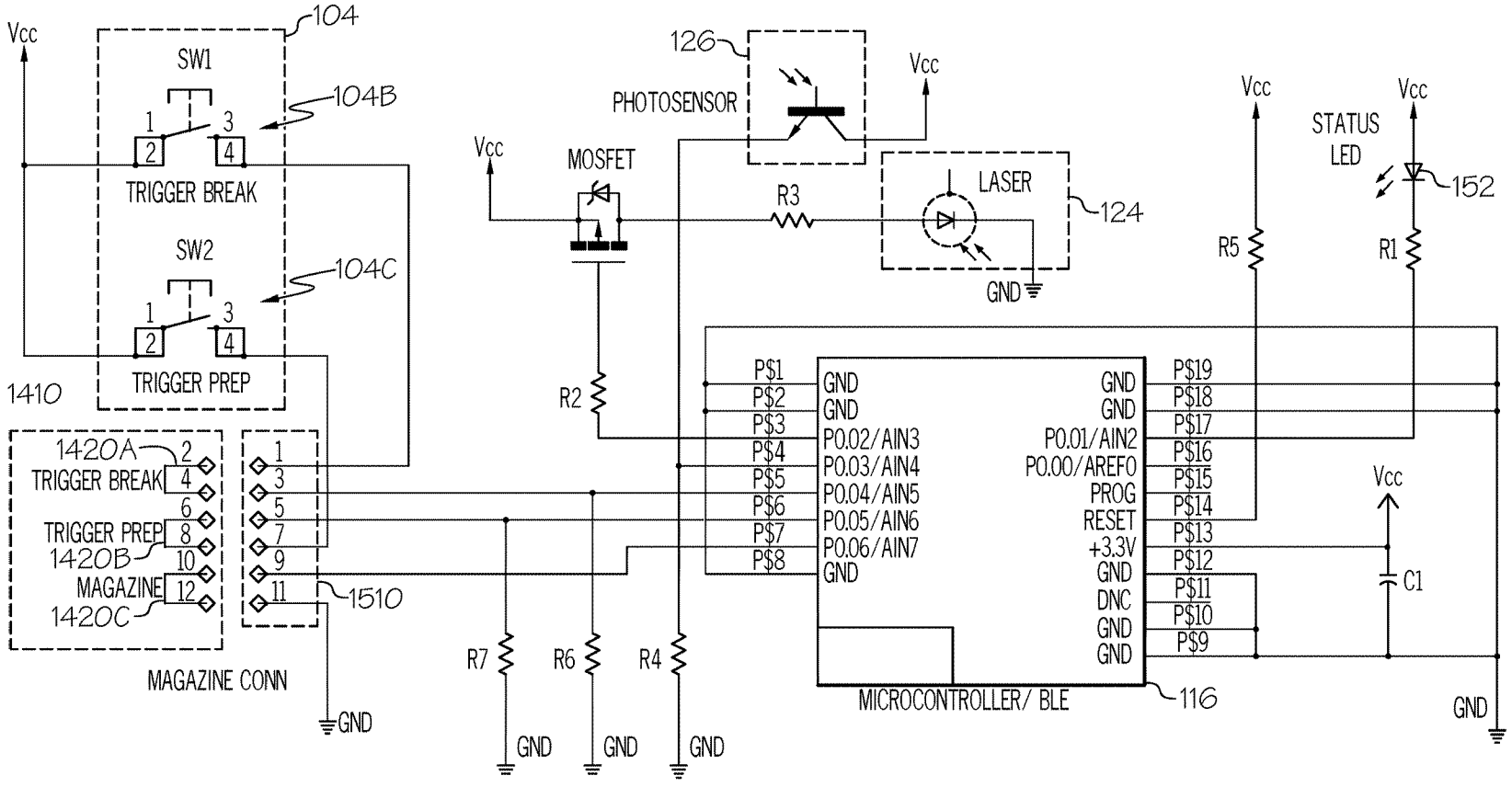
FIG. 16 schematically depicts a schematic diagram of various electronic components of the firearm simulator of FIG. 15, according to one or more embodiments shown and described herein.

Referring generally to FIGS. 14-16, a firearm simulator includes a magazine, a firearm frame, a trigger unit housed within the firearm frame, and a microcontroller housed within the firearm frame. The magazine includes a magazine head connector. The firearm frame includes a magazine well for receiving the magazine. When the magazine is retained in the magazine well, the trigger unit is electrically coupled to the magazine head connector and the magazine head connector is electrically coupled to the microcontroller, such that the trigger unit is electrically coupled to the microcontroller. When the magazine is not retained in the magazine well, the trigger unit is not electrically coupled to the microcontroller.

Embodiments of firearm simulators will be described in more detail herein with reference to the attached figures.

Figure 1:
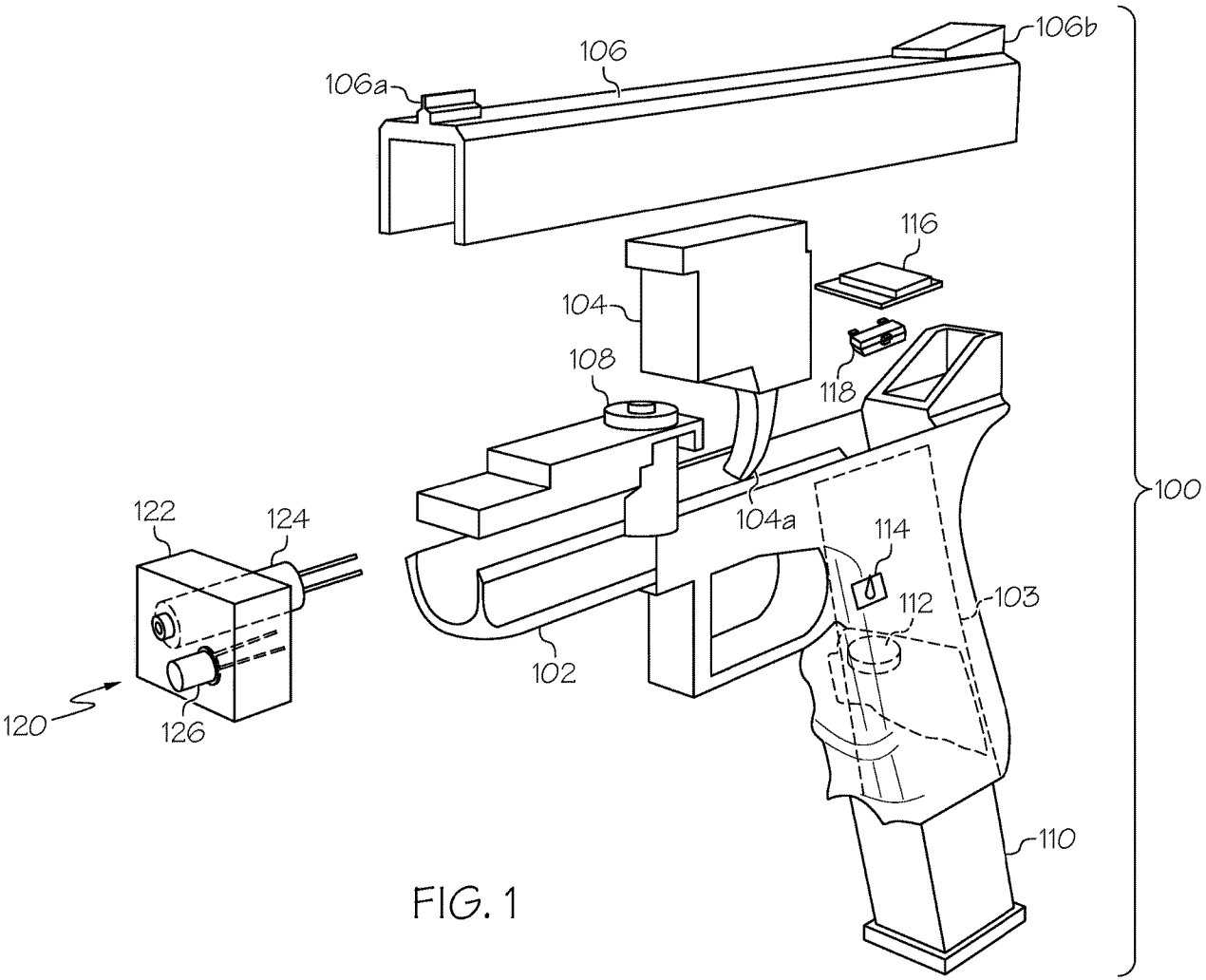
FIG. 1 schematically depicts an exploded view of a firearm simulator, according to one or more embodiments shown and described herein.

Referring now to FIG. 1, an exploded view of a firearm simulator 100 is schematically depicted. The firearm simulator 100 includes a firearm frame 102, a trigger unit 104, a firearm slide 106, a battery 108, a magazine 110, a magnet 112, a magazine release button 114, a microcontroller 116, a magazine sensor 118, and an optoelectronic assembly 120. The various components of the firearm simulator 100 will now be described with reference to FIG. 1.

Still referring to FIG. 1, when the firearm simulator 100 is assembled, the firearm frame 102 houses or is coupled to the other components of the firearm simulator 100. In the embodiment depicted in FIG. 1, the firearm frame 102 has a pistol shape. In other embodiments, the firearm frame 102 may have a different shape, such as in embodiments in which the firearm frame 102 has a revolver shape, a rifle shape, a submachine gun shape, a machine gun shape, or a shape of another type of firearm. The firearm frame 102 includes a magazine well 103 for receiving the magazine 110.

Still referring to FIG. 1, the trigger unit 104 of the firearm simulator 100 is housed within the firearm frame 102, such that the trigger 104*a* of the trigger unit 104 protrudes from the firearm frame 102 in a manner that allows the trigger 104*a* to be manipulated by a user of the firearm simulator 100. The trigger unit 104 is communicatively coupled to the microcontroller 116 and provides a trigger output signal to the microcontroller 116 that is indicative of a position of the trigger 104*a*. In some embodiments, the trigger output signal may include a trigger prep signal indicative that the trigger 104*a* is in a trigger prep state, and a trigger break signal indicative that the trigger 104*a* is in a trigger break state. As used herein, a "trigger prep state" is a state in which a position of the trigger 104*a* has moved from an initial position (i.e. a steady state position of the trigger 104*a* when no force is applied to the trigger 104*a*) to a trigger prep threshold position. As used herein, a "trigger break state" is a state in which a position of the trigger 104*a* has moved beyond the trigger prep threshold position to a trigger break threshold position. The trigger 104*a* may be in the trigger prep state when the trigger 104*a* is positioned between the trigger prep threshold position and the trigger break threshold position. The trigger 104*a* may be in the trigger break state when the trigger 104*a* is positioned between the trigger break threshold position and a terminal trigger position (i.e. a position of the trigger when maximal force is applied to the trigger). In some embodiments, the trigger unit 104 may only output a single trigger output signal, such as embodiments in which the trigger output signal is proportional to a linear position of the trigger 104*a*.

Still referring to FIG. 1, the firearm simulator 100 includes the firearm slide 106. When the firearm simulator is assembled, the firearm slide 106 forms an upper portion of the firearm simulator 100. The firearm slide 106 includes a front sight 106*a* and a rear sight 106*b* along a top of the firearm slide 106. The front sight 106*a* and the rear sight 106*b* may be used by a user of the firearm simulator 100 to aim the firearm simulator 100 toward a target. In some embodiments, the firearm slide 106 may be easily removed from the firearm simulator 100 such that the internal electronic components (e.g., the battery 108, the trigger unit 104, etc.) of the firearm simulator 100 may be accessed.

Still referring to FIG. 1, the battery 108 of the firearm simulator 100 may be electrically connected to one or more of the electronic components of the firearm simulator 100 and may provide power to one or more of the electronic components of the firearm simulator 100. In some embodiments, the battery 108 is a 3V Lithium battery, though embodiments are not limited thereto. In some embodiments, the firearm simulator 100 may not include a battery, such as embodiments in which the firearm simulator 100 includes a solar power cell, or the like.

Still referring to FIG. 1, the magazine 110 simulates a magazine typically used by semi-automatic firearms to store rounds of ammunition. In some embodiments, the magazine 110 may include weights to simulate the weight and feel of a loaded magazine. The magazine 110 may be inserted into the magazine well 103 of the firearm frame 102 such that the magazine 110 is retained within the magazine well 103 of the firearm frame 102. The magazine 110 includes a magnet 112 embedded within an upper area of the magazine 110, such that the magnet 112 moves into close proximity with the magazine sensor 118 when the magazine 110 is retained within the magazine well 103. As will be explained further below, the magnet 112 may be detected by the magazine sensor 118 to determine when the magazine 110 is inserted or ejected from the magazine well 103. In some embodiments, the magazine 110 does not include the magnet 112, such as embodiments in which the magazine is sensed in another manner or in embodiments that do not include a magazine sensor.

Still referring to FIG. 1, the magazine release button 114 is housed within the firearm frame 102, such that at least a portion of the magazine release button 114 protrudes from the firearm frame 102 and can be pressed by a user of the firearm simulator 100 in order to eject the magazine 110 from the magazine well 103 of the firearm frame 102. When a user presses the magazine release button 114, the magazine 110 may be ejected from the magazine well 103, thereby disengaging the magazine 110 from the firearm frame 102.

Still referring to FIG. 1, the microcontroller 116 is housed and mounted within the firearm frame 102. In some embodiments, the microcontroller 116 includes a processor (e.g., the processor 134 shown in FIG. 2), a memory module (e.g., the memory module 132 shown in FIG. 2), and a wireless communication module (e.g., the wireless communication module 136 shown in FIG. 2). Further details regarding the processor, the memory module, and the wireless communication module are provided below with reference to FIG. 2. Referring once again to FIG. 1, some embodiments may not include a processor, a memory module, and a wireless communication module as part of a single microcontroller 116. For example, in some embodiments, the processor, the memory module, and the wireless communication module may be distributed among more than one component.

Still referring to FIG. 1, the magazine sensor 118 of the firearm simulator 100 is mounted within the firearm frame 102. The magazine sensor 118 outputs a magazine sensor output signal indicative of whether a magazine is sensed by the magazine sensor 118. In some embodiments, the magazine sensor 118 is a magnetic field sensor (e.g., a Hall effect sensor, or the like) positioned proximate the magazine well 103 that outputs a magnetic field sensor output signal that varies based on the position of the magnet 112 of the magazine 110 relative to the magnetic field sensor. In embodiments in which the magazine sensor 118 is a magnetic field sensor, the magnetic field sensor may output a magnetic sensor output signal indicative of a magazine inserted state when the magnet 112 is within a threshold distance of the sensor and may output a magnetic sensor output signal indicative of a magazine ejected state when the magnet 112 is not within the threshold distance of the sensor. The firearm simulator 100 may determine that a magazine has been inserted into the magazine well 103 based on the magnetic field sensor output and transmit a magazine insertion event to a computing device. The firearm simulator 100 may also determine that a magazine has been ejected from the magazine well 103 based on the magazine sensor output and transmit a magazine ejection event to a computing device. In some embodiments, the magazine sensor 118 may be a sensor other than a magnetic field sensor, such as when the magazine sensor 118 is a proximity sensor, a pressure sensor, an electrical switch, or the like.

Still referring to FIG. 1, the optoelectronic assembly 120 of the firearm simulator 100 includes a housing 122, an optoelectronic output device 124 coupled to the housing 122, and an optoelectronic sensor 126 coupled to the housing 122. The optoelectronic output device 124 and the optoelectronic sensor 126 are coupled to the housing 122 such that the optoelectronic output device 124 and the optoelectronic sensor 126 are oriented in a direction parallel to the longitudinal direction in which the firearm slide extends. The housing 122 may include one or more adjustment members configured to adjust the optoelectronic output device 124 and/or the optoelectronic sensor 126 such that the output of the optoelectronic output device 124 coincides with the position viewed through the front sight 106*a* and the rear sight 106*b* of the firearm slide 106. The optoelectronic output device 124 outputs light when activated to simulate a shot fired with the output light. In some embodiments, the optoelectronic output device 124 is a laser diode (e.g., a class 3R 5 mw red (650 nm) or green (532 nm) laser diode), though embodiments are not limited thereto. The optoelectronic sensor 126 senses light and outputs an optoelectronic sensor output signal in response to the sensed light. In some embodiments, the optoelectronic sensor output signal may be an analog signal, though other embodiments may include an optoelectronic sensor that outputs a digital signal. In some embodiments, the optoelectronic sensor 126 is a phototransistor, a photodiode, a light dependent resistor, a photocell, or the like.

Figure 2:
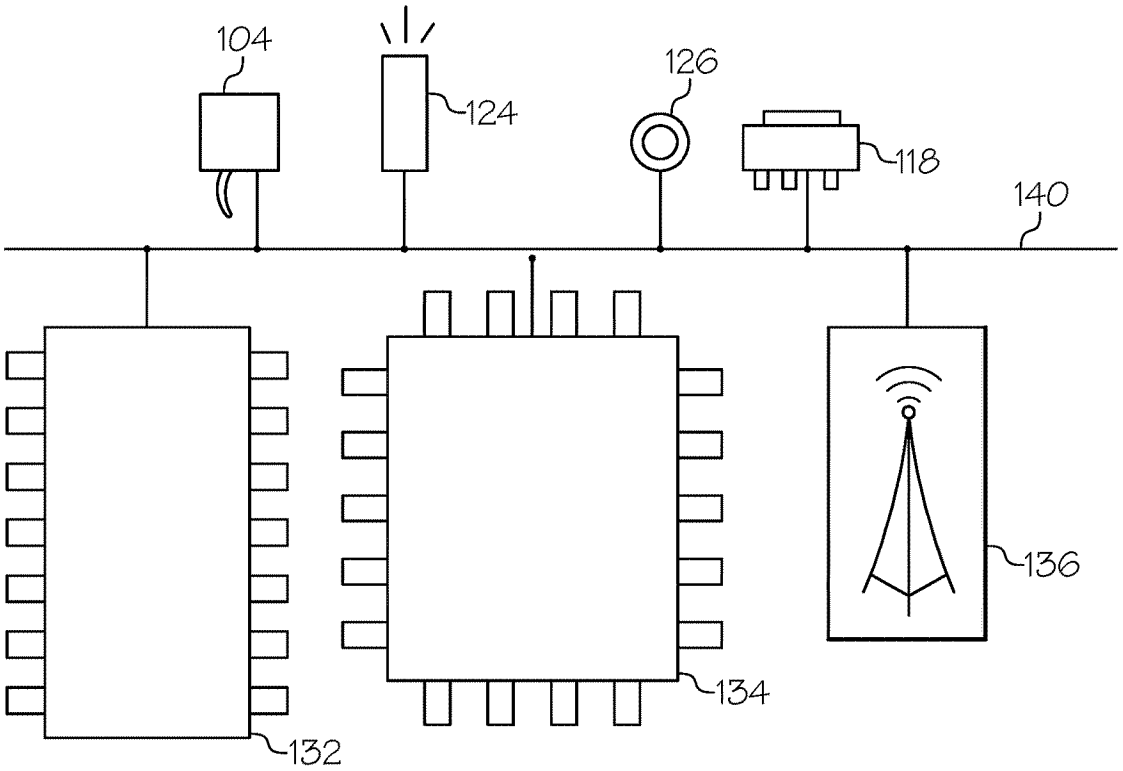
FIG. 2 depicts a schematic diagram of various electronic components of the firearm simulator of FIG. 1, according to one or more embodiments shown and described herein.

Referring now to FIG. 2, a schematic diagram depicting various electronic components of the firearm simulator 100 is provided. The components depicted in FIG. 2 include a memory module 132, a processor 134, a wireless communication module 136, the trigger unit 104, the optoelectronic output device 124, the optoelectronic sensor 126, and the magazine sensor 118. The components are interconnected by a communication path 140.

Still referring to FIG. 2, the communication path 140 may be formed from any medium that is capable of transmitting a signal such as, for example, conductive wires, conductive traces, optical waveguides, or the like. Moreover, the communication path 140 may be formed from a combination of mediums capable of transmitting signals. In one embodiment, the communication path 140 comprises a combination of conductive traces, conductive wires, connectors, and buses that cooperate to permit the transmission of electrical data signals to components such as processors, memories, sensors, input devices, output devices, and communication devices. The term "signal" means a waveform (e.g., electrical, optical, magnetic, mechanical or electromagnetic), such as DC, AC, sinusoidal-wave, triangular-wave, square-wave, vibration, and the like, capable of traveling through a medium. The communication path 140 communicatively couples the various components of the firearm simulator 100. As used herein, the term "communicatively coupled" means that coupled components are capable of exchanging data signals with one another such as, for example, electrical signals via conductive medium, electromagnetic signals via air, optical signals via optical waveguides, and the like.

Still referring to FIG. 2, the processor 134 may be any device capable of executing machine readable instructions. Accordingly, the processor 134 may be a controller, an integrated circuit, a microchip, a computer, or any other computing device. The processor 134 is communicatively coupled to the other components of the firearm simulator 100 by the communication path 140. While the embodiment depicted in FIG. 2 includes only one processor 134, other embodiments may include multiple processors communicatively coupled with one another by the communication path 140.

Still referring to FIG. 2, the memory module 132 of the firearm simulator 100 is coupled to the communication path 140 and communicatively coupled to the processor 134. The memory module 132 may comprise RAM, ROM, flash memories, hard drives, or any device capable of storing machine readable instructions such that the machine readable instructions can be accessed and executed by the processor 134. The machine readable instructions may comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored on the memory module 132. Alternatively, the machine readable instructions may be written in a hardware description language (HDL), such as logic implemented via either a field-programmable gate array (FPGA) configuration or an application-specific integrated circuit (ASIC), or their equivalents. Accordingly, the functionality described herein may be implemented in any conventional computer programming language, as pre-programmed hardware elements, or as a combination of hardware and software components.

Still referring to FIG. 2, the wireless communication module 136 is coupled to the communication path 140 and communicatively coupled to the processor 134. The wireless communication module 136 may be any device capable of transmitting and/or receiving data via a network. Accordingly, the wireless communication module 136 can include a communication transceiver for sending and/or receiving any wired or wireless communication. For example, the wireless communication module 136 may include an antenna, a modem, LAN port, Wi-Fi card, WiMax card, mobile communications hardware, near-field communication hardware, satellite communication hardware and/or any wired or wireless hardware for communicating with other networks and/or devices. In one embodiment, the wireless communication module 136 includes hardware configured to operate in accordance with the Bluetooth® wireless communication protocol. In some embodiments, the wireless communication module 136 may be a wireless communication module configured to transmit and/or receive wireless signals according to the Bluetooth® 4.0 communication protocol. In such embodiments, the wireless communication module 136 may transmit and receive signals using less energy than other less energy efficient wireless communication protocols. However, in some embodiments the wireless communication module 136 is configured to transmit and/or receive wireless signals in accordance with a wireless communication protocol other than the Bluetooth® 4.0 communication protocol. Some embodiments may not include the wireless communication module 136, such as embodiments that include a wired communication module for transmitting and/or receiving data via a wired network.

Still referring to FIG. 2, the trigger unit 104 is coupled to the communication path 140 and communicatively coupled to the processor 134. In some embodiments, the trigger unit 104 includes one or more electrical switches that change the output of the trigger unit 104 when the one or more electrical switches are opened or closed. The trigger unit 104 outputs a trigger output signal indicative of a position of the trigger of the trigger unit 104. In some embodiments, the trigger output signal may include a trigger prep signal indicative that the trigger is in a trigger prep state, and a trigger break signal indicative that the trigger is in a trigger break state. In some embodiments, the trigger unit 104 may only output a single trigger output signal, such as embodiments in which the trigger output signal is proportional to a linear position of the trigger.

Still referring to FIG. 2, the optoelectronic output device 124 is coupled to the communication path 140 and communicatively coupled to the processor 134. The optoelectronic output device 124 outputs light when activated to simulate a shot fired with the output light. In some embodiments, the optoelectronic output device 124 is activated or deactivated in response to machine readable instructions executed by the processor 134.

Still referring to FIG. 2, the optoelectronic sensor 126 is coupled to the communication path 140 and communicatively coupled to the processor 134. The optoelectronic sensor 126 senses light and outputs an optoelectronic sensor output signal in response to the sensed light. In some embodiments, the optoelectronic sensor output signal may be an analog signal, though other embodiments may include an optoelectronic sensor that outputs a digital signal.

Still referring to FIG. 2, the magazine sensor 118 is coupled to the communication path 140 and communicatively coupled to the processor 134. The magazine sensor 118 outputs a magnetic field sensor output signal. In some embodiments, the magazine sensor output signal may be a digital signal, though other embodiments may include an analog magazine sensor output signal.

Figure 3:
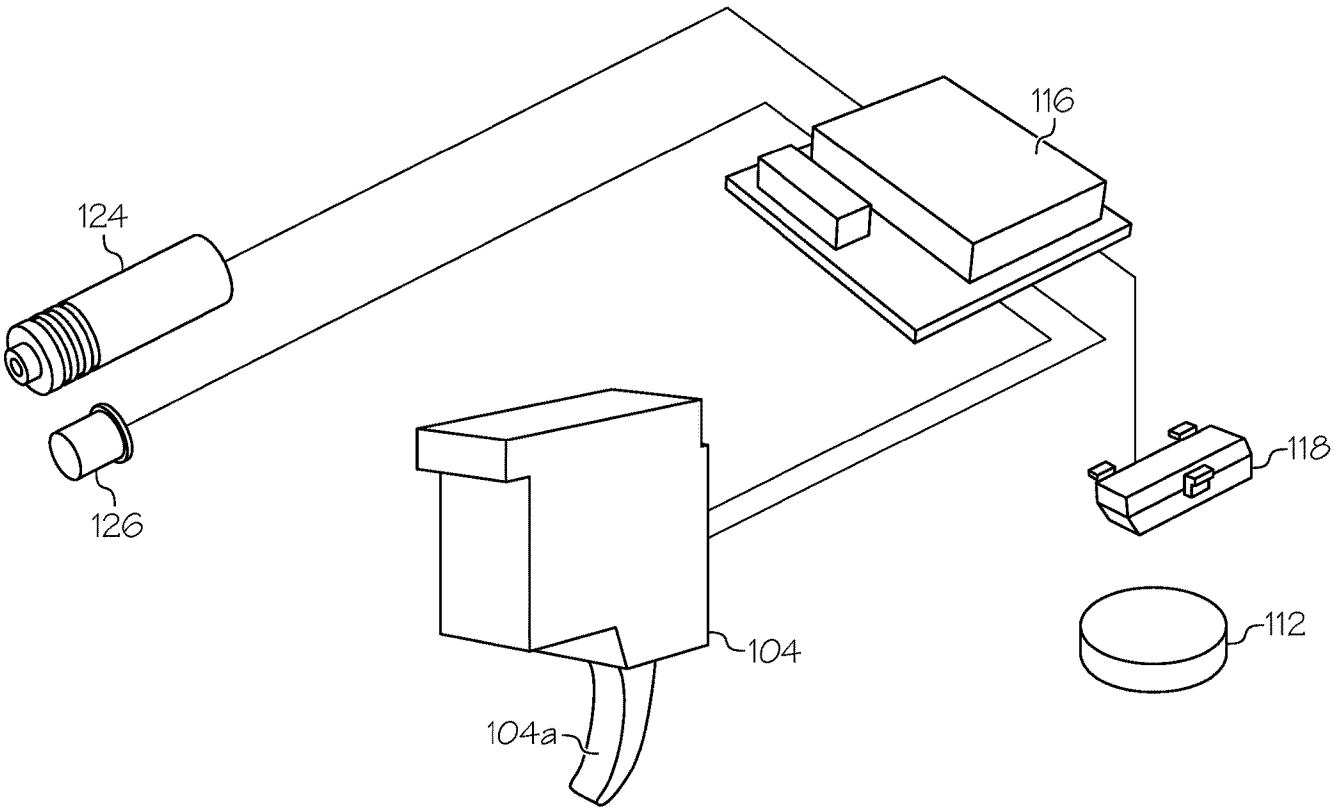
FIG. 3 schematically depicts a microcontroller communicatively coupled to other electronic components of the firearm simulator of FIG. 1, according to one or more embodiment shown and described herein.

In some embodiments, the processor 134, the memory module 132, and the wireless communication module 136 may be components of a microcontroller unit, such as the microcontroller 116 of FIG. 1. In such embodiments, the microcontroller unit may be communicatively coupled to the trigger unit 104, the optoelectronic output device 124, the optoelectronic sensor 126, and the magazine sensor 118, such as when at least one output or input of each of the trigger unit 104, the optoelectronic output device 124, the optoelectronic sensor 126, and the magazine sensor 118 are connected to at least one pin of the microcontroller unit. For example, referring now to FIG. 3, each of the trigger unit 104, the magazine sensor 118, the optoelectronic output device 124, and the optoelectronic sensor 126 are communicatively coupled to the microcontroller 116.

Figure 4:
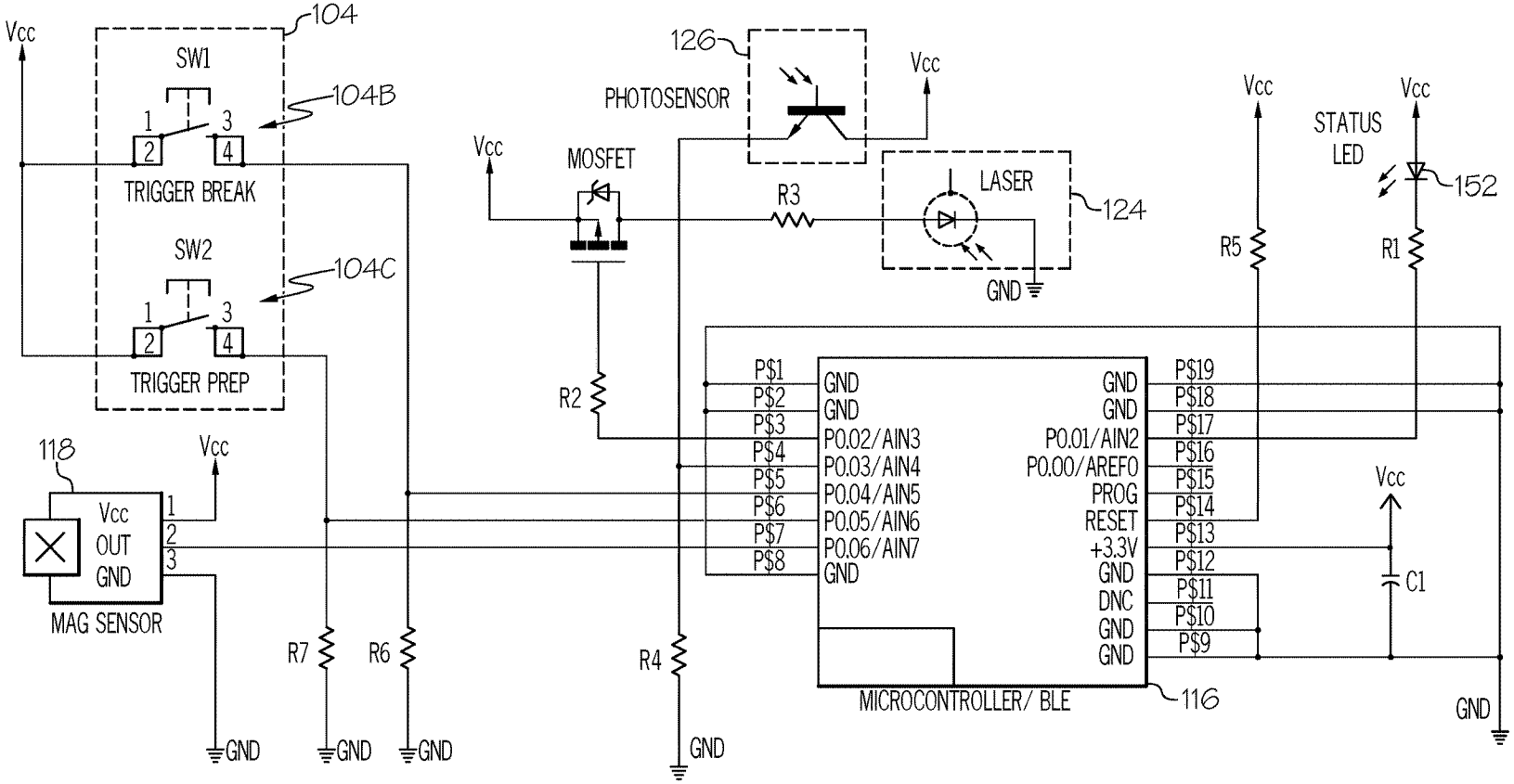
FIG. 4 depicts a schematic diagram of various electronic components of the firearm simulator of FIG. 1, according to one or more embodiments shown and described herein.

Referring now to FIG. 4, a circuit schematic of the electronic components of the firearm simulator is schematically depicted. As depicted in FIG. 4, the trigger unit 104 is communicatively coupled to the microcontroller 116, the optoelectronic output device 124 is communicatively coupled to the microcontroller 116, the optoelectronic sensor 126 is communicatively coupled to the microcontroller 116, and the magazine sensor 118 is communicatively coupled to the microcontroller 116.

Still referring FIG. 4, the trigger unit 104 includes a trigger break switch **104*b* and a trigger prep switch 104*c*. The trigger break switch 104*b* outputs a trigger break output signal to input pin P\$5 of the microcontroller 116. The trigger break output signal is indicative of whether the trigger is in a trigger break position. In the embodiment depicted in FIG. 4, the trigger break switch 104*b* is closed when the trigger is in the trigger break position, causing the trigger break switch 104*b* to output a high trigger break output signal to input pin P\$5 of the microcontroller 116. The trigger break switch 104*b* is open when the trigger is not in the trigger break position, causing the trigger break switch 104***b* to output a low trigger break output signal to input pin P\$5 of the microcontroller 116. When executed by a processor of the microcontroller 116, machine readable instructions stored in the memory module of the microcontroller 116 cause the microcontroller to determine whether a trigger break event has occurred based on the trigger break output signal received at input pin P\$5 (e.g., by determining that a trigger break event has occurred when the trigger break output signal is high and by determining that a trigger break event has not occurred when the trigger break output signal is low). In some embodiments, the firearm simulator 100 transmits a trigger break event to a remote computing device (e.g., the computing device 166 of FIG. 5) and the remote computing device may process the trigger break event and perform one or more functions in response to receiving the trigger break event, as will be described below.

Still referring to the trigger unit 104 of FIG. 4, the trigger prep switch 104*c* outputs a trigger prep output signal to input pin P\$6 of the microcontroller 116. The trigger prep output signal is indicative of whether the trigger is in a trigger prep position. In the embodiment depicted in FIG. 4, the trigger prep switch 104*c* is closed when the trigger is in the trigger prep position, causing the trigger prep switch 104*c* to output a high trigger prep output signal to input pin P\$6 of the microcontroller 116. The trigger prep switch 104*c* is open when the trigger is not in the trigger prep position, causing the trigger prep switch 104*c* to output a low trigger prep output signal to input pin P\$6 of the microcontroller 116. When executed by a processor of the microcontroller 116, machine readable instructions stored in the memory module of the microcontroller 116 cause the microcontroller to determine whether a trigger prep event has occurred based on the trigger prep output signal received at input pin P\$6 (e.g., by determining that a trigger prep event has occurred when the trigger prep output signal is high and by determining that a trigger prep event has not occurred when the trigger prep output signal is low). In some embodiments, the firearm simulator 100 transmits a trigger prep event to a remote computing device (e.g., the computing device 166 of FIG. 5) and the remote computing device may process the trigger prep event and perform one or more functions in response to receiving the trigger prep event, as will be described below.

Still referring to FIG. 4, the magazine sensor 118 outputs a magazine sensor output signal to input pin P\$7 of the microcontroller 116. The magazine sensor output signal is indicative of whether a magazine is sensed by the magazine sensor 118. In embodiments in which the magazine sensor 118 is a magnetic field sensor (e.g., a Hall effect sensor, or the like) positioned proximate the magazine well 103 of the firearm frame 102 (FIG. 1), the magazine sensor output signal may vary based on the position of the magnet 112 of the magazine 110 relative to the magnetic field sensor. When executed by a processor of the microcontroller 116, machine readable instructions stored in the memory module of the microcontroller 116 cause the microcontroller to determine whether a magazine insertion event has occurred based on the magazine sensor output signal received at input pin P\$7 (e.g., by determining that a magazine insertion event has occurred when the magazine sensor output signal changes from a logical low to a logical high, when the magazine sensor output signal exceeds a threshold voltage, or the like). When executed by a processor of the microcontroller 116, machine readable instructions stored in the memory module of the microcontroller 116 cause the microcontroller to determine whether a magazine ejection event has occurred based on the magazine sensor output signal received at input pin P\$7 (e.g., by determining that a magazine ejection event has occurred when the magazine sensor output signal changes from a logical high to a logical low, when the magazine sensor output signal falls below a threshold voltage, or the like). In some embodiments, the firearm simulator 100 transmits a magazine insertion event, a magazine ejection event, or both a magazine insertion event and a magazine ejection event to a remote computing device (e.g., the computing device 166 of FIG. 5) and the remote computing device may process the magazine insertion event or the magazine ejection event and perform one or more functions in response to receiving the magazine insertion event or the magazine ejection event, as will be described below.

Still referring to FIG. 4, the optoelectronic sensor 126 outputs an optoelectronic sensor output signal to an analog input P\$4 of the microcontroller 116 in response to sensed light. While the optoelectronic sensor 126 outputs an analog optoelectronic sensor output signal in the embodiment depicted in FIG. 4, the optoelectronic sensor 126 may output a digital signal to a digital input of the microcontroller 116 in other embodiments. When executed by a processor of the microcontroller 116, machine readable instructions stored in the memory module of the microcontroller 116 cause the microcontroller to determine an ambient light value based on the optoelectronic sensor output signal, determine a reflected light value based on the optoelectronic sensor output signal, and/or use such values to determine whether a target hit event or a target miss event has occurred, as will be explained in further detail below.

Still referring to FIG. 4, the optoelectronic output device 124 is communicatively coupled to output pin P\$3 of the microcontroller. The optoelectronic output device 124 outputs light when activated to simulate a shot fired with the output light. In some embodiments, the optoelectronic output device 124 is a laser diode, though embodiments are not limited thereto. When executed by a processor of the microcontroller 116, machine readable instructions stored in the memory module of the microcontroller 116 cause the microcontroller to activate the optoelectronic output device 124 (e.g., by changing an output provided by the output pin P\$3 of the microcontroller 116 from a logical high to a logical low), deactivate the optoelectronic output device 124 (e.g., by changing an output provided by the output pin P\$3 of the microcontroller 116 from a logical low to a logical high), or maintain the optoelectronic output device in an activated or deactivated state (e.g., by maintaining the output provided to the optoelectronic output device 124 at a constant logical level).

Still referring to FIG. 4, a status LED 152 is communicatively coupled to an output pin P\$17 of the microcontroller 116 and may be controlled by the microcontroller 116 to indicate a status of the firearm simulator, such as when a hit event occurs, when the optoelectronic output device 124 is active, or the like. FIG. 4 also depicts various resistors, capacitors, and other electronic components. It should be understood that the specific circuits used to interconnect the microcontroller 116, the trigger unit 104, the magazine sensor 118, the optoelectronic sensor 126, and the optoelectronic output device 124 may differ in other embodiments. Accordingly, embodiments are not limited to the specific components or circuit configurations depicted in FIG. 4.

Figure 5:
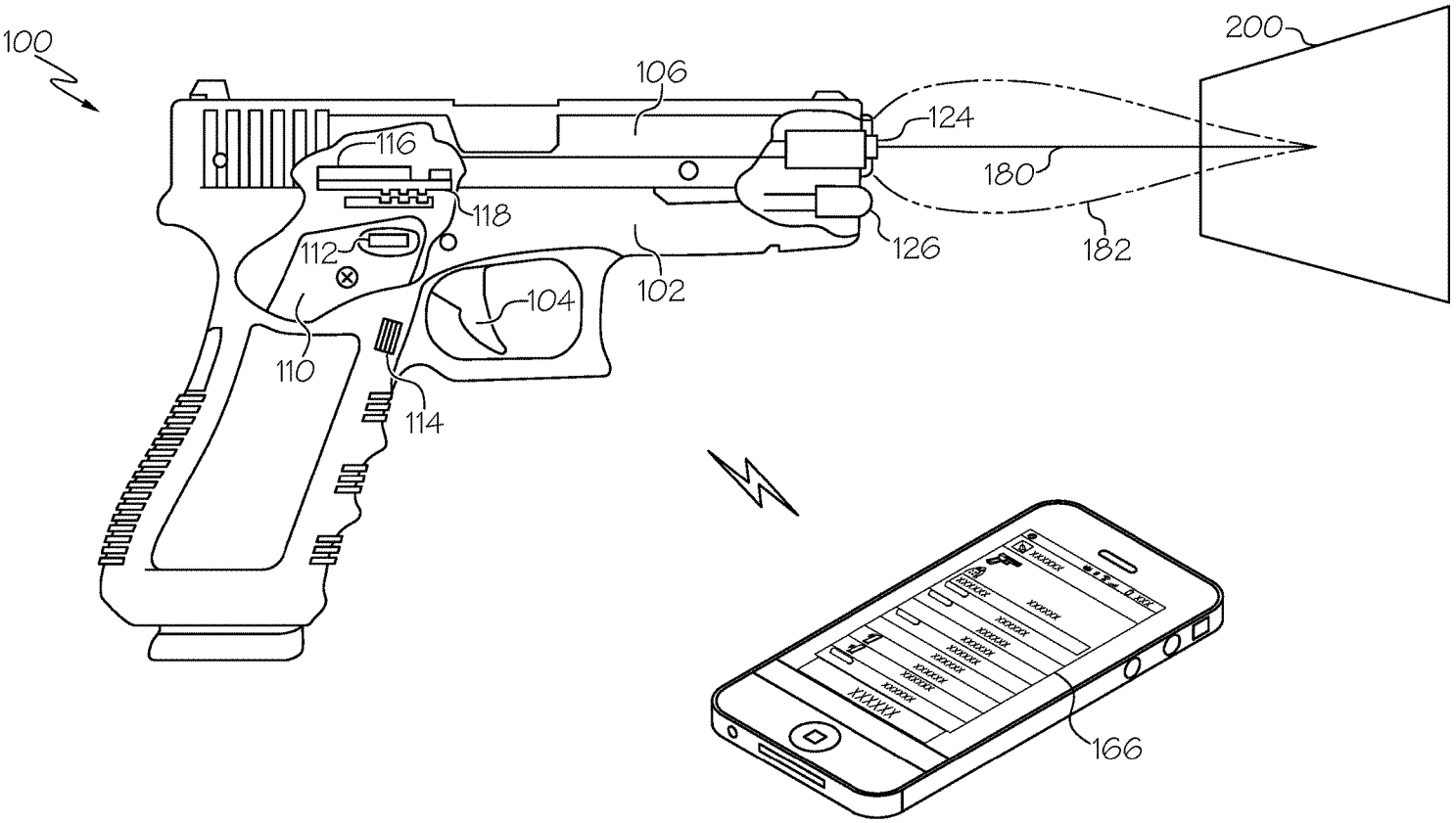
FIG. 5 schematically depicts a firearm simulator communicating with a computing device while in use, according to one or more embodiments shown and described herein.

Referring now to FIG. 5, a firearm simulator 100 communicating with a computing device 166 while the firearm simulator 100 is in use to fire a simulated round at a retroreflective target 200 is schematically depicted. The retroreflective target 200 includes a surface that reflects light directly back to a source with a minimum scattering. In some embodiments, the retroreflective target 200 includes reflective tape. In some embodiments, the retroreflective target 200 includes sheeting material that includes microprismatic optics of the corner cube or spherical glass bead types. The retroreflective target 200 may be formed from material having a variety of colors. In some embodiments, the retroreflective target 200 may include graphic images (e.g., target graphics, bull's-eye graphics, or the like) printed on a surface of the retroreflective target 200.

Still referring to FIG. 5, the firearm simulator 100 may be activated by a user by pulling the trigger. The firearm simulator 100 may determine that a trigger break event has occurred based on a trigger output signal output by the trigger unit 104. In response to determining that the trigger break event has occurred, the firearm simulator 100 may activate the optoelectronic output device 124 to output light 180 to simulate a shot fired with the output light 180. The output light 180 may be incident on a retroreflective target 200 and reflected from the retroreflective target 200 as reflected light 182. The optoelectronic sensor 126 senses the reflected light 182 and outputs an optoelectronic sensor output signal in response to the reflected light 182. The firearm simulator 100 may determine whether a target hit event or a target miss event has occurred based on the optoelectronic sensor output signal provided in response to the reflected light 182, as will be described further below.

Still referring to FIG. 5, the firearm simulator 100 is communicatively coupled to the computing device 166 via a network. In one embodiment, the network is a personal area network that utilizes Bluetooth® technology (e.g., Bluetooth® 4.0) to communicatively couple the firearm simulator 100 and the computing device 166. In other embodiments, the network 160 may include one or more computer networks (e.g., a personal area network, a local area network, or a wide area network), cellular networks, satellite networks and combinations thereof. Accordingly, the firearm simulator 100 can be communicatively coupled to the computing device 166 via wires, via a wide area network, via a local area network, via a personal area network, via a cellular network, via a satellite network, etc. Suitable local area networks may include wired Ethernet and/or wireless technologies such as, for example, wireless fidelity (Wi-Fi). Suitable personal area networks may include wireless technologies such as, for example, IrDA, Bluetooth®, Wireless USB, Z-Wave, ZigBee, and/or other near field communication protocols. Suitable personal area networks may similarly include wired computer buses such as, for example, USB and FireWire. Suitable cellular networks include, but are not limited to, technologies such as LTE, WiMAX, UMTS, CDMA, and GSM.

Still referring to FIG. 5, as stated above, the firearm simulator 100 may be communicatively coupled to the computing device 166. In embodiments described herein, the computing device 166 may include a mobile phone, a smartphone, a personal digital assistant, a dedicated mobile media player, a mobile personal computer, a tablet computer, a laptop computer, a desktop computer and/or any other computing device capable of being communicatively coupled with the firearm simulator 100. The computing device 166 includes a processor, a memory module, a wireless communication module, a speaker, and a display. The processor of the computing device 166 can execute logic to communicate with the firearm simulator 100 and to perform the functionality described below. The computing device 166 may be configured with a wireless communication module (or a wired communication module in embodiments in which the firearm simulator 100 is communicatively coupled to the computing device 166 over a wired network) for communicating with the firearm simulator 100. The computing device 166 comprises a display for providing visual output such as, for example, visual output indicative of information received from the firearm simulator 100, as will be described in detail below. The computing device 166 may also transmit information to the firearm simulator 100 to configure the firearm simulator 100 or to control one or more functions of the firearm simulator 100, as will be described further below.

I. Firearm Simulator Functions

Various functions of the firearm simulator 100 will now be described. In some embodiments, each of the firearm simulator functions described below may be implemented as machine readable instructions stored in the memory module of the firearm simulator 100 that, when executed by the processor of the firearm simulator 100, automatically cause the firearm simulator 100 to perform the steps described. In other embodiments, one or more of the firearm simulator functions described below may be implemented as machine readable instructions stored in a memory module of a remote computing device that, when executed by a processor, automatically cause the firearm simulator 100 to perform the steps described herein. In some embodiments, the machine readable instructions that cause the firearm simulator 100 to perform the functions described below may be distributed among the firearm simulator 100 and one or more remote computing devices. While the methods described below include steps executed according to a specific sequence, other embodiments of the present disclosure may execute the steps in other sequences.

A. Method of Firing a Simulated Round Only when a Simulated Round is Available to Fire Referring to FIG. 5, a method of firing a simulated round with the firearm simulator 100 only when a simulated round is available to fire includes determining whether a trigger break event has occurred based on the trigger output signal provided by the trigger unit 104. The firearm simulator 100 may determine whether a trigger break event has occurred in any manner described herein.

Still referring to FIG. 5, the method further includes determining whether a simulated round is available to be fired. In some embodiments, the firearm simulator 100 may include a round count stored in the memory module of the firearm simulator 100. The round count may be indicative of a number of simulated rounds remaining in the magazine 110 currently inserted in the firearm simulator 100. In some embodiments, the round count may be modified when a magazine insertion event has occurred, such as when the round count is set to a number of rounds present in a full magazine when the magazine insertion event has occurred. The round count may be decremented each time a trigger break event is detected and the firearm simulator 100 activates the optoelectronic output device 124 to fire a simulated round. When the round count is decremented to less than one (e.g., to zero), the round count indicates that the magazine is empty. In embodiments that include a round count stored in memory, the firearm simulator 100 may determine that the simulated round is available to be fired when the round count is greater than zero, indicating that at least one round is available in the magazine to be fired. The firearm simulator 100 may determine that a simulated round is not available to be fired when the round count is less than zero (e.g., when the round count is zero). In some embodiments, the firearm simulator 100 may determine that a simulated round is not available to be fired when the firearm simulator 100 senses that a magazine is not present (e.g., based on the magazine sensor output signal provided by the magazine sensor 118).

Still referring to FIG. 5, some embodiments transmit the round count to the computing device 166. Some embodiments may transmit a round count to the computing device 166 when a magazine insertion event is determined to have occurred. Some embodiments may transmit the magazine round count to the computing device 166 each time the firearm simulator 100 fires a simulated round. Other embodiments may transmit a message that a simulated round has been fired to the computing device 166, which may update its round count appropriately. Some embodiments do not transmit a round count to the computing device 166. In such embodiments, the computing device 166 may determine a number of rounds currently available based on magazine insertion events, magazine ejection events, and firing events transmitted from the firearm simulator 100 to the computing device 166.

The method further includes activating the optoelectronic output device 124 when the trigger break event has occurred and the simulated round is available to be fired. By activating the optoelectronic output device 124, the firearm simulator 100 proceeds with the simulated firing of an available round because a simulated round was available to be fired.

The method further includes maintaining the optoelectronic output device 124 in a deactivated state when the trigger break event has occurred and the simulated round is not available to be fired. By maintaining the optoelectronic output device in the deactivated state when the trigger break has occurred and the simulated round is not available to be fired, the firearm simulator 100 simulates a situation in which a user attempts to fire, but there are no rounds remaining in the magazine. Simulating such an event will enable a user to realize that the current magazine is empty and should be replaced. The user may then eject the magazine 110 and insert the magazine 110 to continue firing simulated rounds. In such a situation, the firearm simulator 100 may determine that a magazine ejection event has occurred (e.g., based on the magazine sensor output signal output by the magazine sensor 118), determine that a magazine insertion event has occurred (e.g., based on the magazine sensor output signal output by the magazine sensor 118), determine that a subsequent trigger break event has occurred after the magazine insertion event has occurred, and then activate the optoelectronic output device 124 in response to the subsequent trigger break event. In embodiments that include a round count stored in memory, the firearm simulator 100 may modify the round count after the magazine insertion event has occurred, such as by setting the round count to equal the number of rounds in a full magazine. The user may then continue to fire simulated rounds until the current magazine is once again empty.

B. Method of Determining Target Hit Events

Referring to FIG. 5, a method of determining target hit events includes determining an ambient light value based on the optoelectronic sensor output signal output by the optoelectronic sensor 126 when the optoelectronic output device 124 is in a deactivated state. The ambient light value provides an indication of an amount of ambient light present in the direction that the firearm simulator 100 is pointed (i.e., in the direction that the optoelectronic sensor 126 is directed).

The method further includes determining whether a trigger break event has occurred based on the trigger output signal provided by the trigger unit 104. The firearm simulator 100 may determine whether a trigger break event has occurred in any manner described herein.

The method further includes activating the optoelectronic output device 124 when the trigger break event has occurred to allow for the simulated firing of the firearm simulator 100. The optoelectronic output device 124 is activated to output light 180 to simulate a shot fired. The output light 180 is incident on the retroreflective target 200 and reflected from the retroreflective target 200 as reflected light 182.

The method further includes determining a reflected light value based on the optoelectronic sensor output signal output by the optoelectronic sensor 126 as a result of sensing the reflected light 182 when the optoelectronic output device 124 is activated. The reflected light value is indicative of an amount of light sensed by the optoelectronic sensor 126 when the optoelectronic output device 124 is activated.

The method further includes determining that a target hit event has occurred based on the reflected light value and the ambient light value. In some embodiments, the firearm simulator 100 determines that a target hit event has occurred by calculating a difference between the ambient light value and a reflected light value, and determining that the target hit event has occurred based on the difference (e.g., when the difference is equal to a threshold distance, when the difference is greater than a threshold difference, or when the difference is equal to or greater than a threshold difference).

Still referring to determining that a target hit event has occurred based on the reflected light value and the ambient light value, in some embodiments, the firearm simulator 100 determines a hit threshold value based on the ambient light value, compares the reflected light value to the hit threshold value, and determines that the target hit event has occurred based on the comparison of the reflected light value and the hit threshold value. In some embodiments, the hit threshold value may be the sum of the ambient light value and a predefined threshold value. Some embodiments may determine the hit threshold value based on a light sensitivity setting stored in memory. In some embodiments that determine that a target hit event has occurred based on a comparison of the reflected light value to the hit threshold value, the target hit event is determined to occur when the reflected light value is equal to the threshold value, when the reflected light value is greater than the hit threshold value, or when the reflected light value is equal to or greater than the hit threshold value.

Still referring to determining that a target hit event has occurred based on the reflected light value and the ambient light value, in some embodiments, the firearm simulator 100 determines a time series of reflected light values based on the optoelectronic sensor output signal when the optoelectronic output device 124 is activated, calculates a running average reflected light value based on the time series of reflected light values (e.g., by averaging the time series of reflected light values), compares the running average reflected light value with the ambient light value, and determines that the target hit event has occurred based on the comparison of the running average reflected light value and the ambient light value.

Still referring to determining that a target hit event has occurred based on the reflected light value and the ambient light value, in some embodiments, the firearm simulator 100 determines a time series of reflected light values based on the optoelectronic sensor output signal when the optoelectronic output device 124 is activated, calculates a running average reflected light value based on the time series of reflected light values (e.g., by averaging the time series of reflected light values), compares the running average reflected light value with a hit threshold value, and determines that the target hit event has occurred based on the comparison of the running average reflected light value and the hit threshold value. In some embodiments that determine that a target hit event has occurred based on a comparison of the running average reflected light value to the hit threshold value, the target hit event is determined to occur when the running average reflected light value is equal to the threshold value, when the running average reflected light value is greater than the hit threshold value, or when the running average reflected light value is equal to or greater than the hit threshold value. In some embodiments, the target hit event is transmitted from the firearm simulator 100 to the computing device 166.

Some embodiments may determine that a target miss event has occurred when the firearm simulator 100 determines that a target hit event has not occurred. Other embodiments may separately determine whether a target miss event has occurred based on the ambient light value and the reflected light value in a similar manner as described above with respect to determining whether a target hit event has occurred (e.g., by determining that the reflected light does not exceed the ambient light value by a sufficient amount). In some embodiments, the target miss event is transmitted from the firearm simulator 100 to the computing device 166.

C. Method of Transmitting Trigger Events

Referring to FIG. 5, a method of transmitting trigger events from the firearm simulator 100 to the computing device 166 includes determining whether a trigger prep event has occurred based on the trigger output signal provided by the trigger unit 104. The firearm simulator 100 may determine whether a trigger prep event has occurred in any manner described herein. The firearm simulator 100 transmits the trigger prep event to the computing device 166 with the wireless communication module when the trigger prep event is determined to have occurred.

The method further includes determining whether a trigger break event has occurred based on the trigger output signal provided by the trigger unit 104. The firearm simulator 100 may determine whether a trigger break event has occurred in any manner described herein. The firearm simulator 100 transmits the trigger break event to the computing device 166 with the wireless communication module when the trigger break event is determined to have occurred.

Some embodiments may also determine whether a trigger release event has occurred based on the trigger output signal provided by the trigger unit 104. As used herein, a "trigger release event" is an event in which the trigger 104*a* has moved past a trigger release threshold position toward an initial position (i.e. a steady state position of the trigger 104*a* when no force is applied to the trigger 104*a*), such as when force is removed from the trigger 104*a* to allow the trigger 104*a* to return to the initial position. The firearm simulator 100 may transmit the trigger release event to the computing device 166 with the wireless communication module when the trigger release event is determined to have occurred.

Upon receiving the trigger prep event, the trigger break event, or the trigger release event, the computing device 166 may: track trigger prep events, trigger break events, and trigger release events; calculate statistics regarding trigger prep events, trigger break events, and trigger release events; display graphical depictions of trigger break events, trigger prep events, and trigger release events; or the like. Such information and graphics may allow a user of the firearm simulator 100 to understand tendencies and to make adjustments to trigger manipulation to achieve better shooting performance.

D. Firearm Simulator Control Flowchart

Figure 6A:
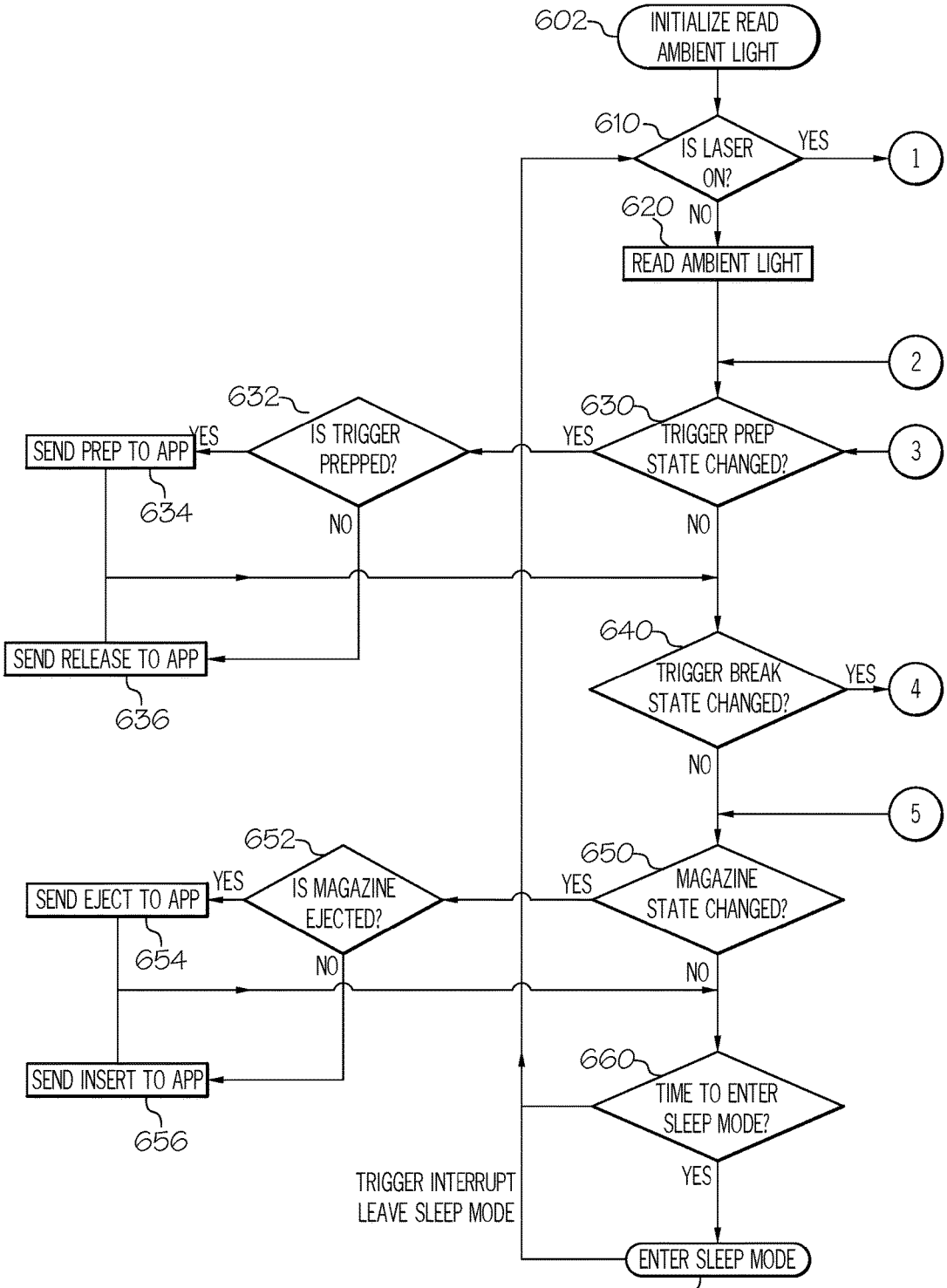
FIGS. 6A-6B schematically depicts a flowchart of a method for controlling a firearm simulator, according to one or more embodiments shown and described herein.
Figure 6B:
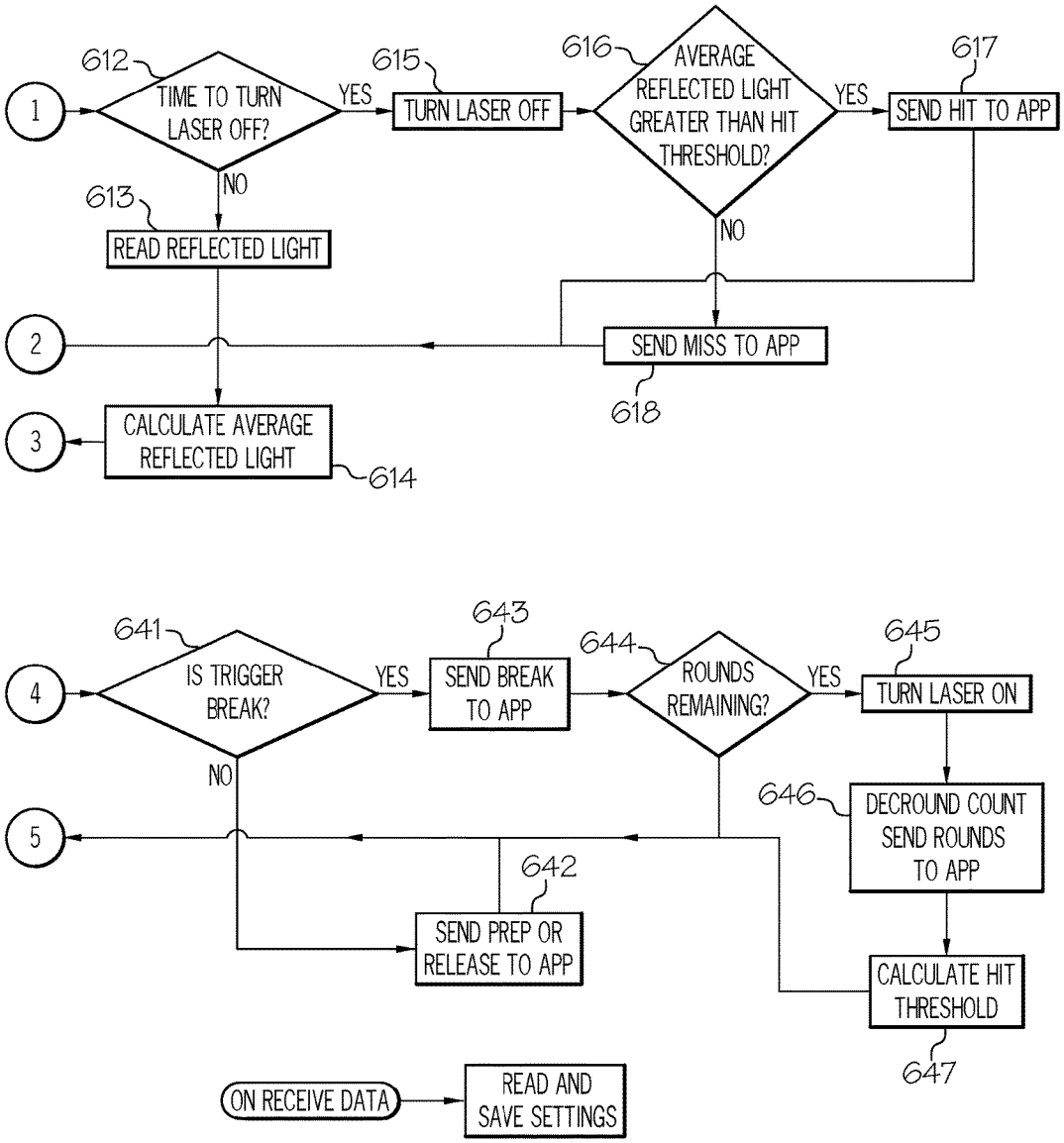

Referring now to FIGS. 6A-6B and FIG. 4, a flowchart for a method of controlling the firearm simulator 100 is schematically depicted. While the following method is described in the context of the components depicted in FIG. 4, which include a laser diode as the optoelectronic output device 124, a photo sensor as the optoelectronic sensor 126, and a trigger unit 104 that includes both a trigger break switch 104*b* and a trigger prep switch 104*c*, embodiments are not limited thereto. For example, in some embodiments, the firearm simulator 100 may activate an optoelectronic output device other than a laser module to output light. In some embodiments, the firearm simulator 100 may include an optoelectronic sensor other than a photo sensor. In some embodiments, the firearm simulator 100 may not include a separate trigger break switch 104*b* and a separate trigger prep switch 104*c*, such as embodiments in which the trigger unit 104 outputs only one trigger output signal that is used to determine both a trigger break event and a trigger prep event.

Still referring to FIGS. 6A-6B and FIG. 4, at block 602, the microcontroller 116 may initialize the hardware and certain internal variables such as the current ambient light value detected by the photo sensor, the number of rounds in the magazine, and a sleep mode timer set to a predefined number of seconds. After being initialized at block 602, machine readable instructions stored in the memory module of the microcontroller 116 may, when executed by the processor of the microcontroller 116, cause the microcontroller 116 to execute a main program loop that includes determining whether the laser is on (i.e., activated) at block 610, samples incoming light detected by the photo sensor to determine an ambient light value at block 620, determining whether a trigger prep state has changed at block 630, determining whether a trigger break state has changed at block 640, determining whether a magazine state has changed at block 650, determining whether it is time to enter a sleep mode at block 660, and entering a sleep mode at block 670.

Still referring to FIGS. 6A-6B and FIG. 4, at block 610, the machine readable instructions stored in the memory module of the microcontroller 116, when executed by the processor of the microcontroller 116, cause the microcontroller 116 to determine whether the laser is on. In some embodiments, the laser is determined to be on when the output of pin P$3 is active. In some embodiments, the laser is determined to be on by accessing a laser state variable in memory and determining that the laser state variable is indicative of an active laser. If the laser is not determined to be on at block 610, the method proceeds to block 620.

Still referring to FIGS. 6A-6B and FIG. 4, if the laser is determined to be on at block 610, the microcontroller 116 determines whether to turn the laser off at block 612, such as by determining whether a laser pulse duration (e.g., 100 ms) has elapsed. If the microcontroller 116 determines not to turn the laser off at block 612, the microcontroller 116 samples incoming light detected by the photo sensor when the laser is on to determine a reflected light value at block 613. At block 614, the reflected light value determined at block 613 is used to calculate a running average of sampled reflected light values since the time the laser was turned on.

Still referring to FIGS. 6A-6B and FIG. 4, if the microcontroller 116 determines to turn the laser off at block 612 (e.g., by determining that the pulse duration time has elapsed), the microcontroller 116 turns the laser off at block 615, such as by changing the logical state of the output pin P$3 of the microcontroller. At block 616, the microcontroller 116 determines whether the running average of reflected light values is greater than a hit threshold value. In some embodiments, the hit threshold value is calculated by the microcontroller 116 as a percentage over the ambient light level known at the time the laser is activated. In some embodiments, the percentage is determined by the configured light sensitivity setting. If the microcontroller 116 determines that the running average of reflected light values is greater than a hit threshold value, the microcontroller determines that a target hit event has occurred at block 616. The running reflected light average may be significantly higher than the known ambient light value when the laser beam strikes a retroreflective target causing a greater amount of reflected light to be detected by the photo sensor than when the laser beam does not strike a retroreflective target. Some embodiments may transmit the target hit event with the wireless communication device to a computing device with a corresponding wireless communication device. If the microcontroller 116 determines that the running average of reflected light values is not greater than a hit threshold value, the microcontroller determines that a target miss event has occurred at block 618. Some embodiments may transmit the target miss event with the wireless communication device to a computing device with a corresponding wireless communication device. After determining that the target miss event has occurred at block 618 or determining that the target hit event has occurred at block 617, the method proceeds to block 620.

Still referring to FIGS. 6A-6B and FIG. 4, at block 620, the machine readable instructions stored in the memory module of the microcontroller 116, when executed by the processor of the microcontroller 116, cause the microcontroller 116 to sample incoming light detected by the photo sensor to determine an ambient light value. The ambient light value may change as the firearm simulator is pointed in different directions. Thus, determining the ambient light value at block 620 as the main loop executes allows for the firearm simulator to continuously update the ambient light value to account for changing lighting conditions.

Still referring to FIGS. 6A-6B and FIG. 4, at block 630, the machine readable instructions stored in the memory module of the microcontroller 116, when executed by the processor of the microcontroller 116, cause the microcontroller 116 to determine whether a trigger prep state has changed. In some embodiments, a change in the trigger prep state is determined by monitoring the input pin P$6 of the microcontroller 116 to determine when the trigger prep switch output signal output by the trigger prep switch 104*c* changes (i.e., changes from a logical high to a logical low, or changes from a logical low to a logical high). If a trigger prep state change is determined at block 630, at block 632, the microcontroller 116 determines whether an output of the trigger prep switch 104*c*, which is received by the input pin P$6 of the microcontroller 116, indicates that the trigger unit is in a trigger prep state. If the trigger unit is determined to be in a trigger prep state at block 632, the microcontroller 116 determines that a trigger prep event has occurred at block 634 and transmits the trigger prep event with the wireless communication device to a computing device with a corresponding wireless communication device. If the trigger unit is not determined to be in a trigger prep state at block 632, the microcontroller 116 determines that a trigger release event has occurred at block 636 and transmits the trigger release event with the wireless communication device to a computing device with a corresponding wireless communication device. After executing block 634 or block 636, the method proceeds to block 640.

Still referring to FIGS. 6A-6B and FIG. 4, at block 640, the machine readable instructions stored in the memory module of the microcontroller 116, when executed by the processor of the microcontroller 116, cause the microcontroller 116 to determine whether a trigger break state has changed. In some embodiments, a change in the trigger break state is determined by monitoring the input pin P$5 of the microcontroller 116 to determine when the trigger break switch output signal output by the trigger break switch 104*b* changes (i.e., changes from a logical high to a logical low, or changes from a logical low to a logical high). If a trigger break state is determined to have changed at block 640, the microcontroller 116 determines whether an output of the trigger break switch 104*b*, which is received by the input pin P$5 of the microcontroller 116, indicates that the trigger unit is in a trigger break state at block 641. If the trigger unit is determined not to be in a trigger break state at block 641, the microcontroller 116 transmits a trigger prep event or a trigger release event (depending on the current state of the trigger prep switch, and the software returns to executing the main loop) with the wireless communication device to a computing device with a corresponding wireless communication device at block 642. If the trigger unit is determined to be in a trigger break state at block 641, the microcontroller 116 determines that a trigger break event has occurred at block 643 and transmits the trigger break event with the wireless communication device to a computing device with a corresponding wireless communication device. At block 644, the microcontroller 116 determines whether rounds are remaining in the current magazine (i.e., by accessing a round count stored in memory) at block 644. If rounds are determined to be remaining at block 644, the microcontroller 116 turns on the laser at block 645, decrements the round count and transmits the round count with the wireless communication device to a computing device with a corresponding wireless communication device at block 646. At block 647, the microcontroller 116 calculates the hit threshold value as described above, resets the sleep mode timer, and proceeds to block 650.

Still referring to FIGS. 6A-6B and FIG. 4, at block 650, the machine readable instructions stored in the memory module of the microcontroller 116, when executed by the processor of the microcontroller 116, cause the microcontroller 116 to determine whether a magazine state has changed. In some embodiments, a change in the magazine state is determined by monitoring the input pin P$7 of the microcontroller 116 to determine when the magazine sensor output signal output by the magazine sensor 118 changes (i.e., changes from a logical high to a logical low, or changes from a logical low to a logical high). If a magazine state change is determined at block 650, at block 652, the microcontroller 116 determines whether an output of the magazine sensor 118, which is received by the input pin P$7 of the microcontroller 116, indicates that the magazine is ejected. If the magazine is determined to be ejected at block 652, the microcontroller 116 determines that a magazine ejection event has occurred at block 654 and transmits the magazine event with the wireless communication device to a computing device with a corresponding wireless communication device. If the magazine is determined not to have been ejected at block 652, the microcontroller 116 determines that a magazine insertion event has occurred at block 656 and transmits the magazine insertion event with the wireless communication device to a computing device with a corresponding wireless communication device. After executing block 654 or block 656, the method proceeds to block 660.

Still referring to FIGS. 6A-6B and FIG. 4, at block 660, the machine readable instructions stored in the memory module of the microcontroller 116, when executed by the processor of the microcontroller 116, cause the microcontroller 116 to determine whether it is time to enter a sleep mode. In some embodiments, it is determined to be time to enter a sleep mode if a sleep mode timer has expired (i.e., has been decremented to zero).

Still referring to FIGS. 6A-6B and FIG. 4, when it is determined that it is time to enter a sleep mode at block 660, the machine readable instructions stored in the memory module of the microcontroller 116, when executed by the processor of the microcontroller 116, cause the microcontroller 116 to enter a sleep mode at block 670 in which the microcontroller 116 may enter a low power mode. After entering sleep mode, the microcontroller 116 may exit sleep mode and return to block 610 upon detecting a trigger prep event or a trigger break event, thereby resuming execution of the main loop.

II. Computing Device Functions

Various functions of the computing device 166 will now be described. In some embodiments, each of the computing device functions described below may be implemented as machine readable instructions stored in the memory module of the computing device that, when executed by the processor of the computing device, automatically cause the computing device to perform the steps described. In other embodiments, one or more of the computing device functions described below may be implemented as machine readable instructions stored in a memory module of the firearm simulator that, when executed by a processor, automatically cause the firearm simulator or computing device to perform the steps described herein. In some embodiments, the machine readable instructions that cause the computing device to perform the functions described below may be distributed among the computing device and a firearm simulator. While the methods described below include steps executed according to a specific sequence, other embodiments of the present disclosure may execute the steps in other sequences.

Figure 7:
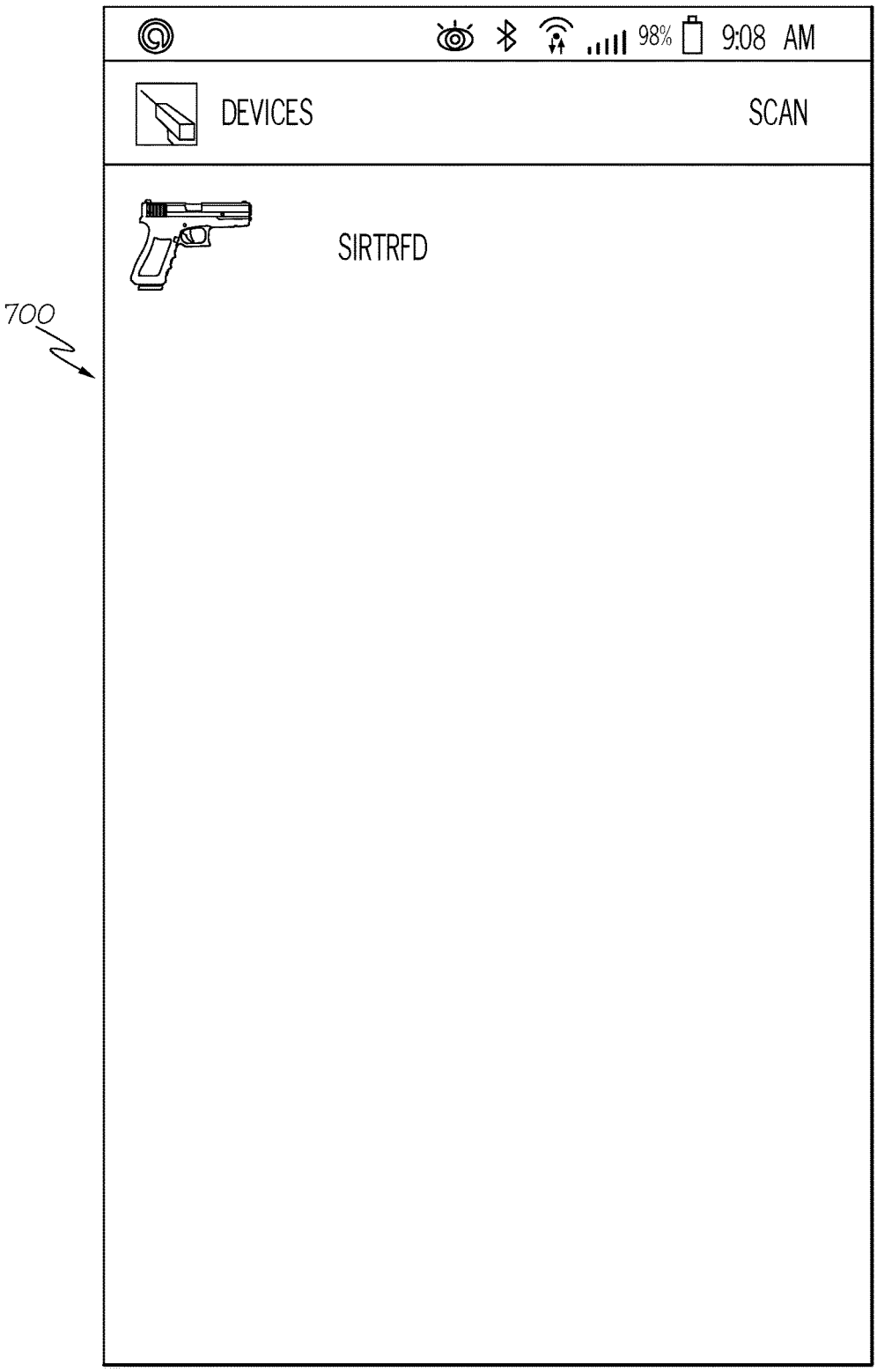
FIG. 7 schematically depicts a list graphical user interface including a list of discovered firearm simulators, according to one or more embodiments shown and described herein.

When the computing device 166 is initialized, the machine readable instructions stored in the memory module of the computing device 166, when executed by the processor of the computing device 166, cause the computing device 166 to scan for compatible devices (e.g., firearm simulators) to which it can connect using the wireless communication module of the computing device 166. In response to the scanning performed by the computing device 166, the firearm simulator transmits a unique identifier to the computing device 166. Firearm simulators that are discovered during the scan process are displayed in a list on the display of the computing device 166. For example, FIG. 7 depicts a list graphical user interface 700 including a list of discovered firearm simulators. The list displayed in FIG. 7 includes a firearm simulator named "SIRTRFD" and the unique identifier that was wirelessly transmitted to the computing device 166 by the firearm simulator. A user may select a firearm simulator from the displayed list. In response to a user selecting a firearm simulator from the displayed list, the computing device 166 may connect to the selected firearm simulator.

Figure 8:
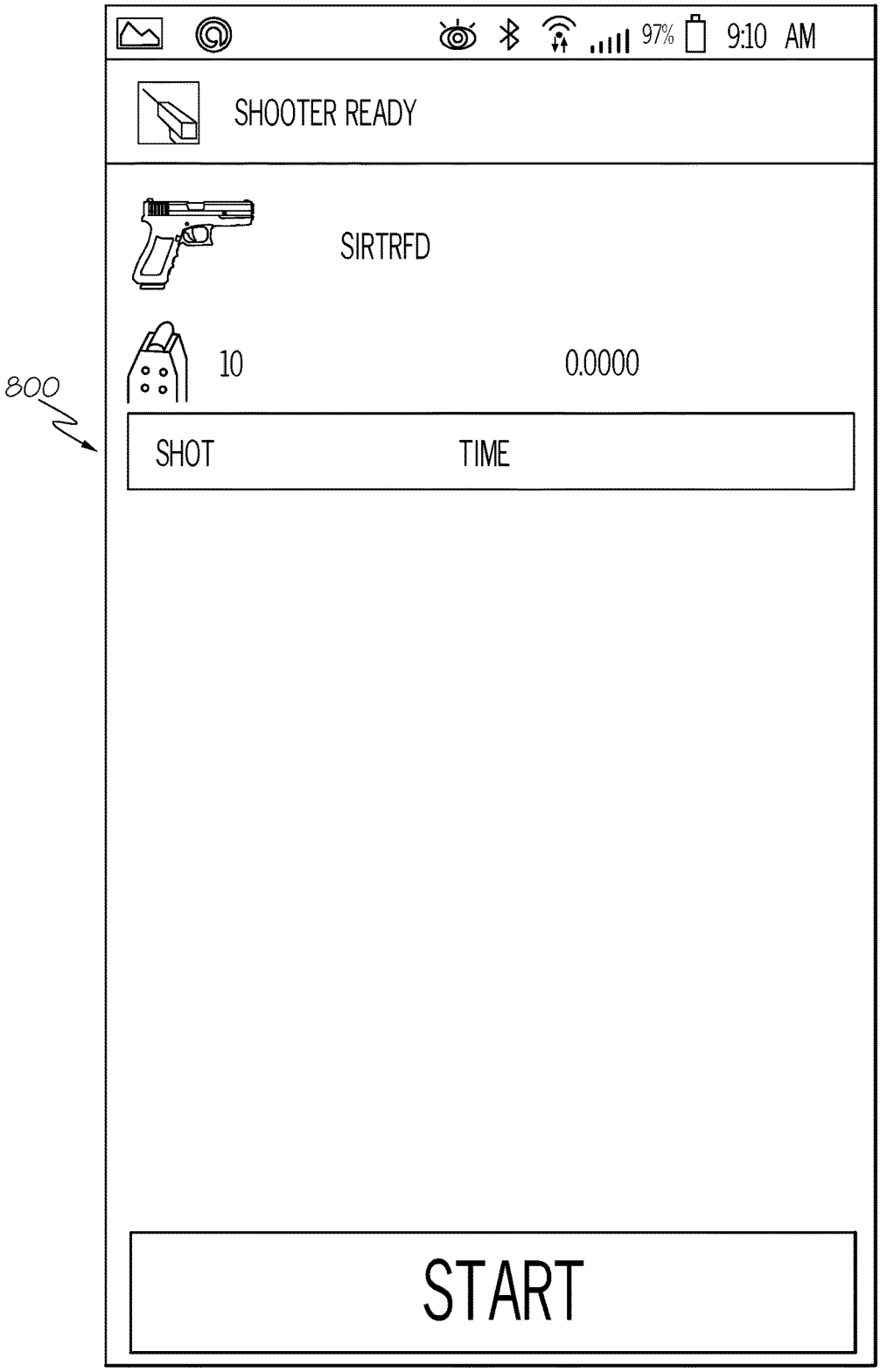
FIG. 8 schematically depicts a start graphical user interface for a firearm simulator, according to one or more embodiments shown and described herein.

Once the computing device 166 and the firearm simulator are connected, the machine readable instructions stored in the memory module of the computing device 166, when executed by the processor of the computing device 166, cause the computing device 166 to displays a start graphical user interface 800, as depicted in FIG. 8. The start graphical user interface 800 includes: the name configured for the connected firearm simulator; the number of rounds currently available in the firearm simulator magazine; the hit factor (which provides the shooter with a single number summarizing their shooting performance for a string of shots, where a higher number equates to a better performance); and a start button that can be pressed to begin shooting a string.

Upon selecting the start button, the machine readable instructions stored in the memory module of the computing device 166, when executed by the processor of the computing device 166, cause the computing device 166 to emit audible instructions to the shooter, followed by the configured tone sound to announce the start of the string. For example, in some embodiments, the computing device may play through a speaker the following sounds: "Are you ready?"; "Standby"; "BEEEEEP."

Once the computing device 166 has been started, the machine readable instructions stored in the memory module of the computing device 166, when executed by the processor of the computing device 166, cause the computing device 166 to start a timer and wait for states and events to be received by the computing device 166 from the firearm simulator. For example, the computing device 166, with its wireless communication module, may receive the following events transmitted by the wireless communication module of the firearm simulator: a trigger prep event, a trigger break event, a trigger release event, a target miss event, a target hit event, a magazine ejection event, a magazine insertion event, a round count state, and the like.

Figure 9:
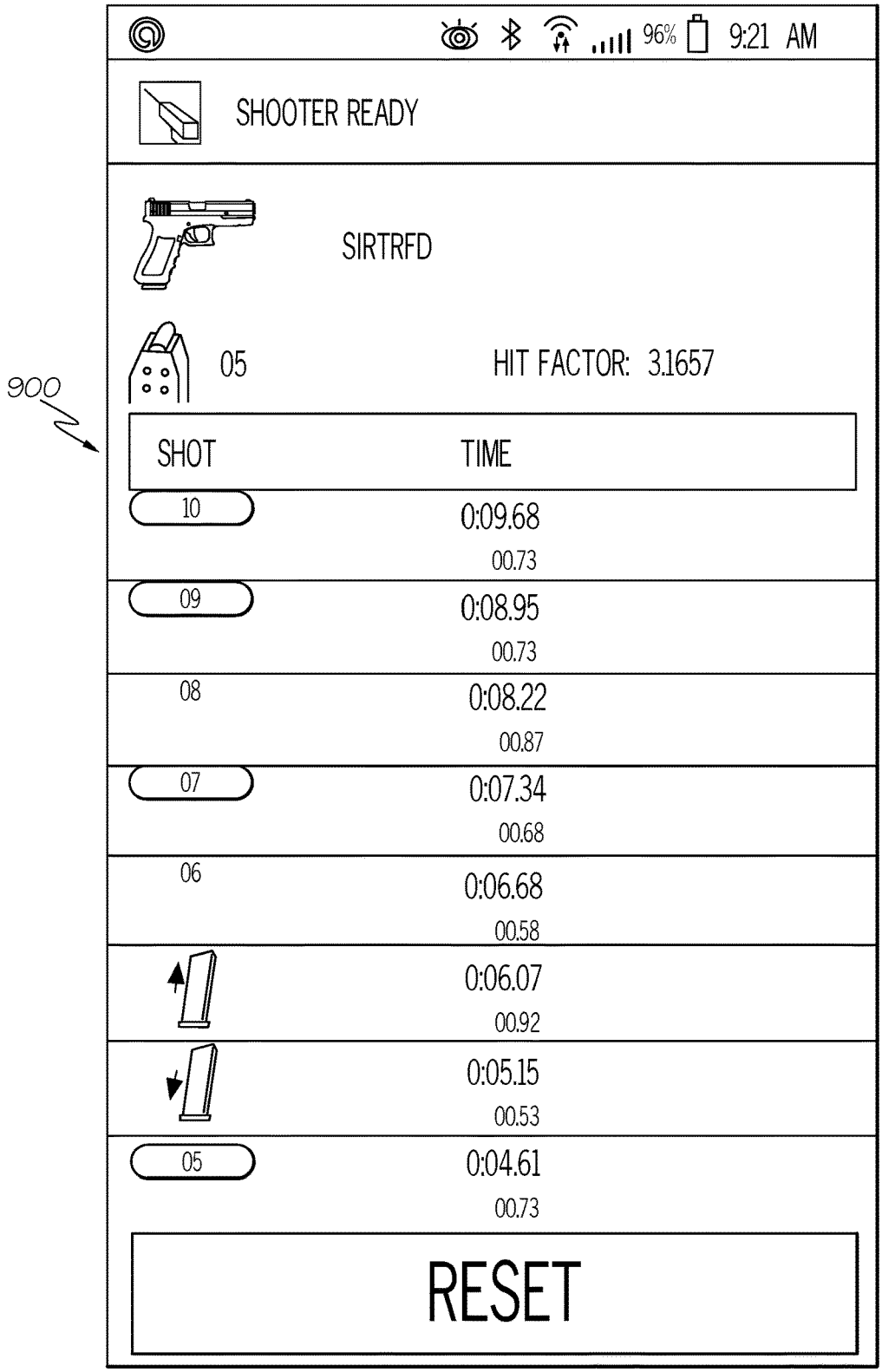
FIG. 9 schematically depicts an event graphical user interface including event and time information, according to one or more embodiments shown and described herein.

Referring now to FIG. 9, as the computing device 166 receives event information from the connected firearm simulator, the computing device 166 displays an event graphical user interface 900 including information pertaining to the events received from the firearm simulators (e.g., target hit events, target miss events, trigger break events, magazine insertion events, magazine ejection events, and the like). The displayed information may include shot fired information (including a number of the shot), target hit or miss indication, the cumulative time for a string, and the split time between shots and magazine changes, as shown in FIG. 9.

When the computing device 166 receives a trigger prep event wirelessly transmitted to the computing device 166 by the firearm simulator, the computing device 166 stores the trigger prep event along with the amount of time elapsed since the timer was started when the tone sounds after the start button was pressed.

When the computing device 166 receives a trigger break event wirelessly transmitted to the computing device 166 by the firearm simulator, if the round count is greater than zero, the computing device 166 stores the trigger break event with the amount of time elapsed since the timer was started when the tone sounds after the start button was pressed. The computing device 166 then emits the sound configured for the trigger break event. In some embodiments, the emitted sound is an audible recording of a gunshot, which is stored in the memory module of the computing device 166.

When the computing device 166 receives a target miss event wirelessly transmitted to the computing device 166 by the firearm simulator, the computing device 166 stores the event with the amount of time elapsed since the timer was started when the tone sounds after the start button was pressed. The computing device 166 may then display the received target miss event in the list (e.g., as shown for shots 6 and 8 in the list of FIG. 9) by displaying the shot number, the cumulative time in large text, and the split time below the cumulative time in smaller text.

When the computing device 166 receives a target hit event wirelessly transmitted to the computing device 166 by the firearm simulator, the computing device 166 stores the event with the amount of time elapsed since the timer was started when the tone sounds after the start button was pressed. The computing device 166 may also emit the sound configured for the target hit event, which is typically an audible recording of a bullet hitting a steel plate that is stored in the memory module of the computing device 166. The computing device 166 may then display the received target hit event in the list (e.g., as shown for shots 5, 7, 9, and 10 in the list of FIG. 9) by displaying the shot number (highlighted to graphically indicate a hit), the cumulative time in large text, and the split time below the cumulative time in smaller text.

When the computing device 166 receives a magazine ejection event wirelessly transmitted to the computing device 166 by the firearm simulator, the computing device 166 stores the event with the amount of time elapsed since the timer was started when the tone sounds after the start button was pressed. The computing device 166 may then display the received magazine ejection event in the list (e.g., the magazine ejection entry above shot 5 in the list of FIG. 9) by displaying an icon indicative of a magazine ejection, the cumulative time in large text, and the split time below the cumulative time in smaller text.

When the computing device 166 receives a magazine insertion event wirelessly transmitted to the computing device 166 by the firearm simulator, the computing device 166 stores the event with the amount of time elapsed since the timer was started when the tone sounds after the start button was pressed. The computing device 166 may then display the received magazine ejection event in the list (e.g., the magazine insertion entry above the magazine ejection entry in the list of FIG. 9) by displaying an icon indicative of a magazine insertion, the cumulative time in large text, and the split time below the cumulative time in smaller text.

When the computing device 166 receives a round count from the firearm simulator wirelessly transmitted to the computing device 166 by the firearm simulator, the computing device 166 may display the received round count to the left and above the list, as shown in FIG. 9 with the displayed round count of 5.

After the computing device 166 receives a target hit event or a target miss event, the computing device 166 calculates and displays a hit factor indicative of a performance metric for the current shooting string. For example, in some embodiments, the hit factor is calculated as the number of hits multiplied by 5 divided by the cumulative time and displays the resulting value to four decimal places. The hit factor may be displayed on the event graphical user interface 900 to the right and above the list, as shown in FIG. 9. In other embodiments, the hit factor may be calculated differently.

Still referring to FIG. 9, the event graphical user interface 900 includes a reset button, which may be pressed by a user to reset the system. In some embodiments, upon selecting the reset button, the computing device 166 may clear the displayed list, reset the hit factor to 0.0, and redisplay the start graphical user interface 800 (FIG. 8). At this point, the computing device 166 is ready to be started for a new shot string, as described above. In some embodiments, shot string data may be stored in memory and recalled later by the computing device 166 for comparison with other shot string results.

Figure 10:
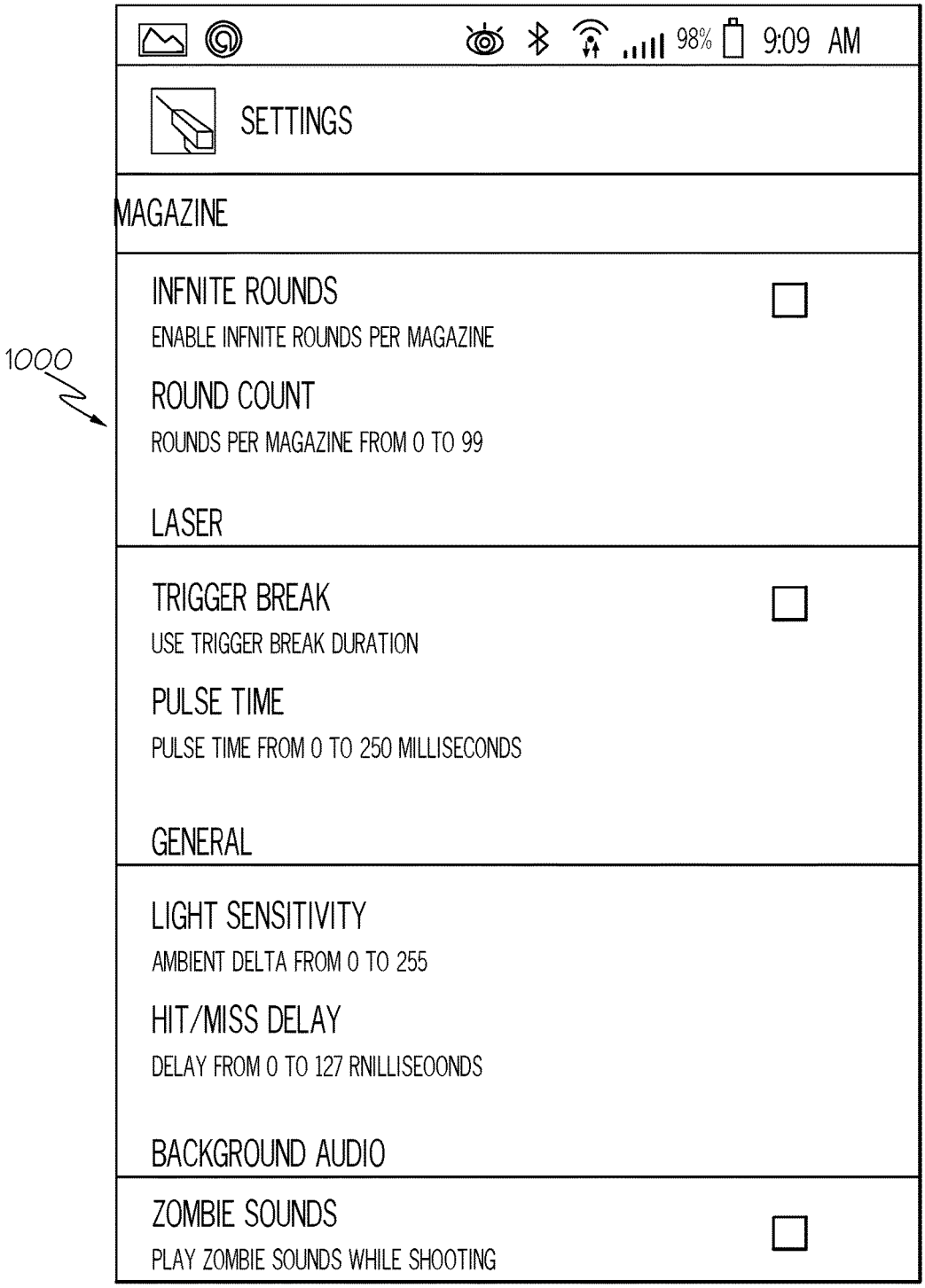
FIG. 10 schematically depicts a configuration graphical user interface for configuring the settings of a firearm simulator, according to one or more embodiments shown and described herein.

Referring now to FIG. 10, in some embodiments, the computing device 166 may display a configuration graphical user interface 1000 for configuring the settings of a firearm simulator system. The settings that may be configured with the configuration graphical user interface 1000 include: an infinite round setting to allow an infinite number of rounds in the magazine, a round count setting to set the number of rounds per magazine, a trigger break setting to set the optoelectronic output device to stay turned on for as long as the trigger break switch is activated, a pulse time setting to set the duration that the optoelectronic output device is turned on after a trigger break event, a light sensitivity setting to set the sensitivity of the optoelectronic sensor (e.g., a percentage of reflected light over ambient light required to indicate a target hit event), a hit/miss delay setting to set the delay after a trigger break event before sampling the optoelectronic sensor output level in order to calculate the average of reflected light values to determine a target hit or miss, and background sound settings to allow the playing of an audio loop in the background while shooting a string, (e.g. emulating the sounds of a nearby zombie horde). In some embodiments, other background sounds may be played, such as additional RO commands, prompts on movement and/or which target to shoot at, battle sound effects, etc. In some embodiments, additional options may be configured, such as configuring the start tone to begin after a fixed number of seconds or after a random delay, configuration of a "Par Time" mode as commonly found in actual shot timers where a start time and end time provides the shooter with audible indications marking the start and end of a "shooting window"; configuring the sounds to be played for trigger break, gunshot for various calibers, target hit, target miss, as well as other shooter instructions and announcements. In some embodiments, upon changing a configuration setting via the configuration graphical user interface 1000, the computing device 166 may wirelessly transmit a configuration update message to the firearm simulator, and the firearm simulator may update at least one setting based upon the configuration update message.

Figure 11:
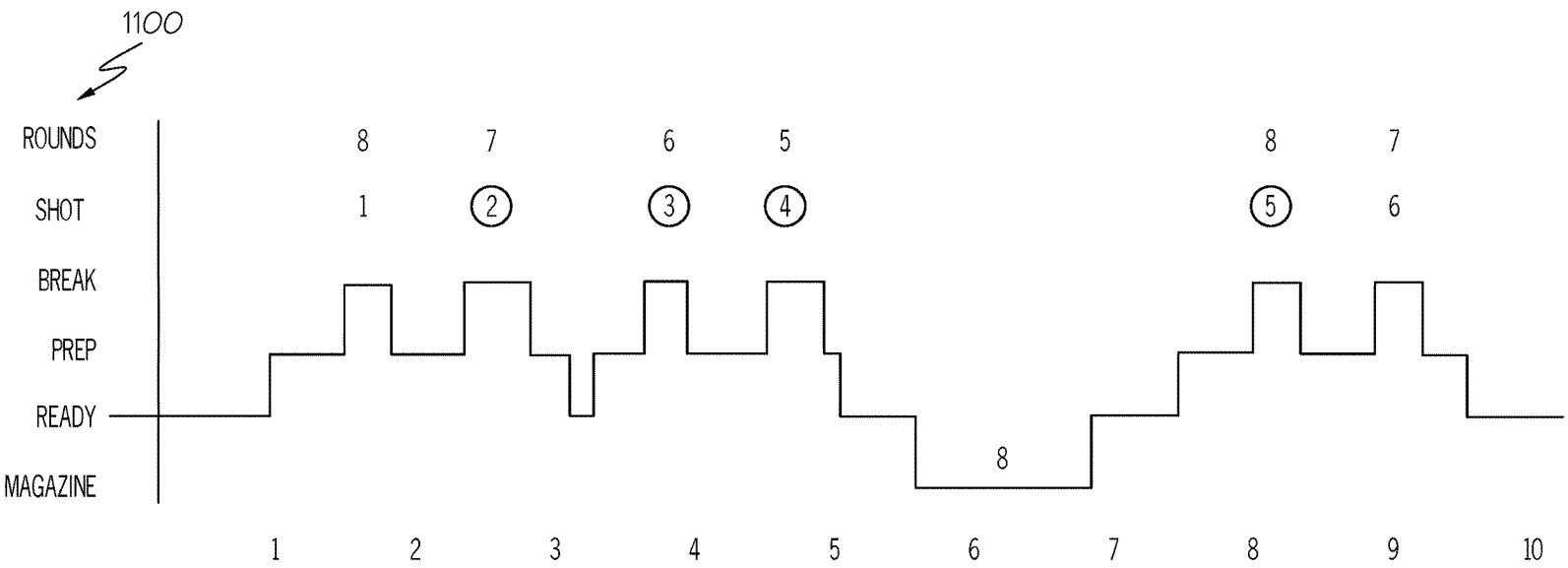
FIG. 11 schematically depicts a profile graphical user interface including a profile summarizing the results of a shot string, according to one or more embodiments shown and described herein.

Some embodiments may display a graphic profile summarizing results of a shot string. For example, FIG. 11 depicts a graphic profile 1100. The graphic profile 1100 includes information pertaining to trigger break events, trigger prep events, magazine insertion events, magazine ejection events, target hit events, target miss events, round count information, and the like. The graphic profile 1100 is a linear timeline of various events. Such a graphic profile may enable a shooter to analyze details of shooting performance to identify where improvements can be made. A shooter may compare graphic profiles with those of other shooters, and strive to duplicate the profiles of shooters that are performing better to learn how to improve their results.

When a user exits the firearm simulator software of the computing device 166, a message is transmitted to the firearm simulator.

In some embodiments, the functionality described above (e.g., sensing and transmitting trigger prep events, trigger break events, trigger release events, target miss events, target hit events, magazine ejection events, magazine insertion events, round count states, and the like) may be performed without requiring the start button to be pressed. For example, in some embodiments, trigger events may be determined and transmitted to the computing device 166 and hit sounds may be played by the computing device 166 before pressing the start button, or after completing a shooting string.

OTHER EMBODIMENTS

Embodiments are not limited to the configuration components depicted and described above with respect to FIGS.

Figure 12:
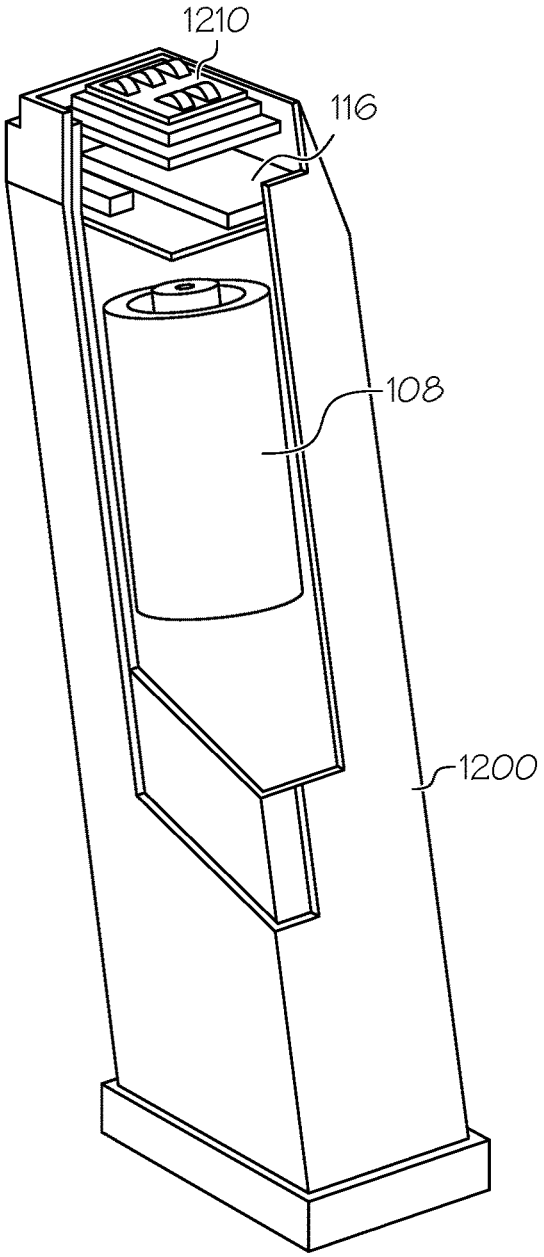
FIG. 12 schematically depicts a magazine including a battery and wireless communication module, according to one or more embodiments shown and described herein.
Figure 13:
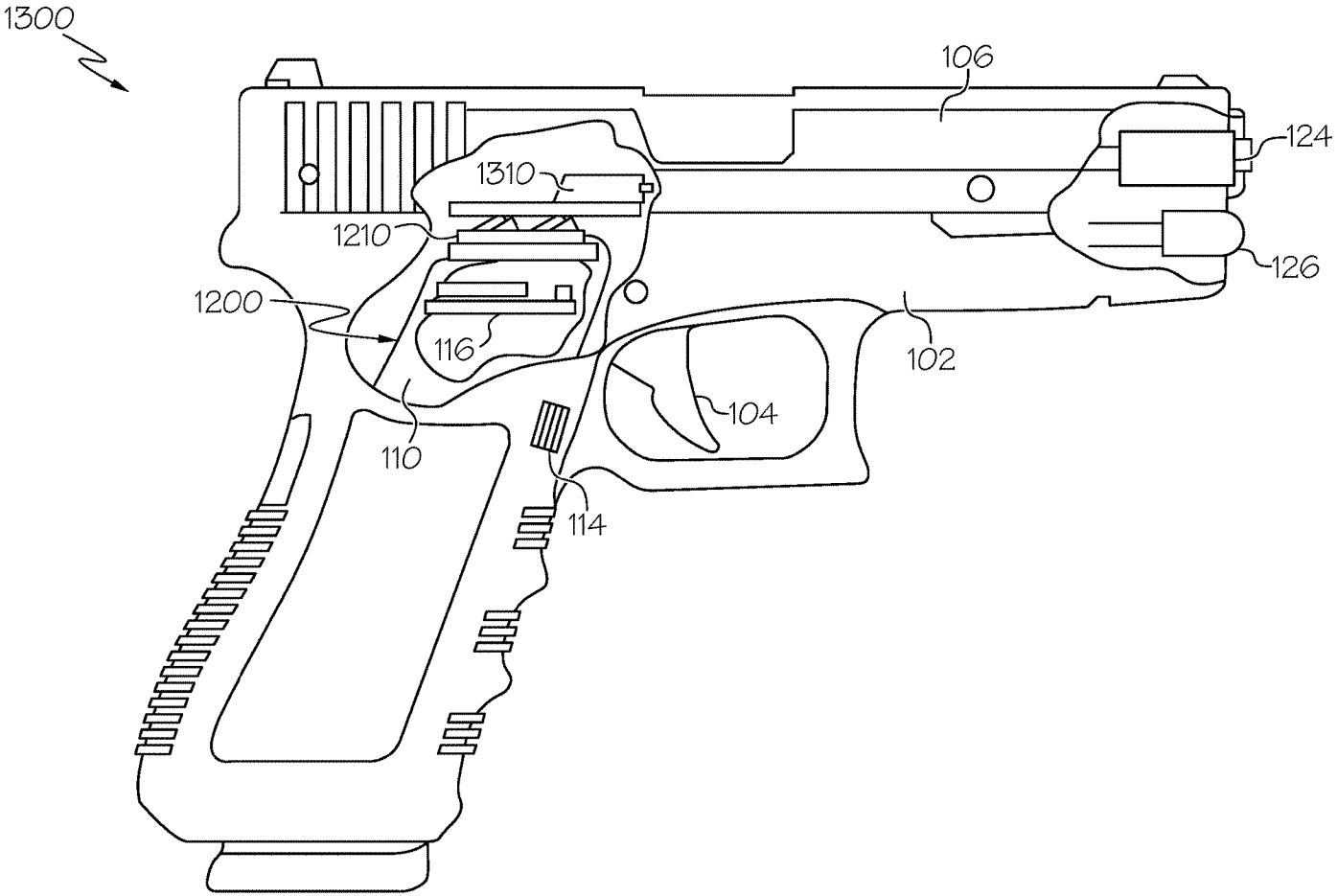
FIG. 13 schematically depicts a firearm simulator including the magazine of FIG. 12, according to one or more embodiments shown and described herein.

1-5. Some embodiments may include additional components other than those depicted in FIGS. 1-5. Other embodiments may not include all of the components depicted in FIGS. 1-5. Other embodiments may include some or all of the components of FIGS. 1-5, but arranged in a different configuration. For example, FIGS. 12-13 depict a firearm simulator 1300 that includes most of the same components as the firearm simulator 100 of FIGS. 1-5, except that the firearm simulator 1300 includes a magazine 1200 that houses the microcontroller 116 and the battery 108. The firearm simulator 1300 may not include a separate magazine sensor.

Still referring to FIGS. 12-13, the microcontroller 116 is housed within the magazine 1200. The magazine 1200 includes a magazine head connector 1210 that includes leaf spring contacts or spring loaded pins (e.g., "pogo pins") that provide low insertion force contact with pads on a sensor connector assembly 1310 that is mechanically coupled to the firearm frame 102 of the firearm simulator 1300. When the magazine 1200 is inserted into the magazine well of the firearm simulator 1300, the contacts or pins of the magazine head connector 1210 are electrically coupled to conductive pads of the sensor connector assembly 1310, thereby electrically coupling the microcontroller 116 to the electronic components of the firearm simulator 1300 (i.e., electrically coupling the microcontroller 116 to the trigger unit 104, the optoelectronic output device 124, and the optoelectronic sensor 126). When the magazine 1200 is inserted into the magazine well of the firearm simulator 1300, the battery 108 is electrically connected to the other electronic components of the firearm simulator 1300 to provide power to the components. When the magazine 1200 is inserted into the magazine well of the firearm simulator 1300, the magazine head connector 1210 and the sensor connector assembly 1310 complete an electrical connection between the battery 108 and a magazine insertion input pin of the microcontroller. The magazine insertion input pin of the microcontroller allows the microcontroller 116 to determine whether the magazine 1200 is inserted within the firearm simulator 1300. When the magazine 1200 is ejected from the magazine well of the firearm simulator 1300, the electrical communication between the microcontroller 116 and the other components of the firearm simulator 1300 (i.e., the trigger unit 104, the magazine sensor, the optoelectronic output device 124, and the optoelectronic sensor 126) is interrupted.

Kit of Parts

A kit of parts for retrofitting or modifying an existing firearm or a firearm simulator may be provided. For example, referring to FIGS. 1 and 3, such a kit of parts may include a microcontroller 116, an optoelectronic sensor 126, a magnet 112, and a magnetic field sensor (i.e., the magazine sensor 118), which may be packaged together in the kit of parts in some embodiments. The microcontroller 116 includes a processor, a memory module, and a wireless communication device. The kit of parts may be used to modify an existing firearm simulator (e.g., a firearm simulator including a firearm slide 106, a trigger unit 104, a firearm frame 102 having a magazine well 103, an optoelectronic output device 124, and a magazine 110) by mechanically coupling the optoelectronic sensor 126 to the firearm simulator 100, mechanically coupling the magnet 112 to the magazine 110, mechanically coupling the magnetic field sensor to the firearm simulator proximate the magazine well 103, mechanically coupling the microcontroller 116 to the firearm simulator, and communicatively coupling the optoelectronic output device 124, the optoelectronic sensor 126, the trigger unit 104, and the magnetic field sensor to the microcontroller 116. In some embodiments, the kit of parts may also include a battery.

In other embodiments, a kit of parts for retrofitting or modifying an existing firearm or a firearm simulator may include a trigger unit 104, a microcontroller 116, an optoelectronic output device 124, an optoelectronic sensor 126, a magnet 112, and a magnetic field sensor (i.e., the magazine sensor 118), which may be packaged together in the kit of parts in some embodiments. The microcontroller 116 includes a processor, a memory module, and a wireless communication device. The kit of parts may be used to modify an existing firearm simulator (e.g., a firearm simulator including a firearm slide 106, a firearm frame 102 having a magazine well 103, and a magazine 110) by mechanically coupling the trigger unit 104 to the firearm simulator, mechanically coupling the optoelectronic output device 124 to the firearm simulator, mechanically coupling the optoelectronic sensor 126 to the firearm simulator, mechanically coupling the magnet 112 to the magazine 110, mechanically coupling the magnetic field sensor to the firearm simulator proximate the magazine well 103, mechanically coupling the microcontroller 116 to the firearm simulator, and communicatively coupling the optoelectronic output device 124, the optoelectronic sensor 126, the trigger unit 104, and the magnetic field sensor to the microcontroller 116. In some embodiments, the kit of parts may also include a battery.

Embodiments in which the Electrical Connection Between One or More Components and the Microcontroller is Interrupted when the Magazine is Ejected FIGS. 14-16 depict a firearm simulator 1500 that includes the like numbered components of the firearm simulator 100 of FIGS. 1-5, but includes a magazine 1400 that includes a magazine head connector 1410, which is different from the magazine of the firearm simulator 100 described with respect to FIGS. 1-5.

Still referring to FIGS. 14-16, the firearm simulator 1500 includes, among other components, a magazine 1400, a firearm frame 102, a trigger unit 104, and a microcontroller 116. The firearm frame 102, the trigger unit 104, and the microcontroller 116 are the same as described above with respect to the firearm simulator 100 of FIGS. 1-5. The magazine 1400 includes a magazine head connector 1410. The firearm frame 102 includes a magazine well for receiving the magazine 1400. The trigger unit 104 and the microcontroller 116 are housed within the firearm frame 102.

Still referring to FIGS. 14-16, the magazine 1400 includes a magazine head connector 1410 that includes a plurality of conductive contacts 1420. In some embodiments, each of the plurality of conductive contacts 1420 is spring loaded. For example, in some embodiments, the plurality of conductive contacts 1420 are conductive leaf spring contacts or spring loaded pins (e.g., "pogo pins") that provide low insertion force contact with corresponding pads on a magazine interface assembly 1510 that is mechanically coupled to the firearm frame 102 of the firearm simulator 1500. When the magazine 1400 is retained in the magazine well of the firearm simulator 1500, the plurality of conductive contacts 1420 are electrically coupled to corresponding conductive pads of the magazine interface assembly 1510 of the firearm simulator 1500.

Referring to FIG. 16 (in conjunction with FIG. 15), when the magazine 1400 is retained in the magazine well, the trigger unit 104 is electrically coupled to the magazine head connector 1410 and the magazine head connector 1410 is electrically coupled to the microcontroller 116 (and the wireless communication module of the microcontroller 116), such that the trigger unit 104 is electrically coupled to the microcontroller 116 (and the wireless communication module of the microcontroller 116). In particular, in the example embodiment depicted in FIG. 16, the magazine head connector 1410 includes a first conductive contact 1420*a* and a second conductive contact 1420*b*. When the magazine 1400 is retained in the magazine well, the trigger break switch 104*b* is electrically coupled to the first conductive contact 1420*a* and the first conductive contact 1420*a* is electrically coupled to input pin P\$5 of the microcontroller 116, such that the trigger break switch 104*b* is electrically coupled to input pin P\$5 of the microcontroller 116. Similarly, when the magazine 1400 is retained in the magazine well, the trigger prep switch 104*c* is electrically coupled to the second conductive contact 1420*b* and the second conductive contact 1420*b* is electrically coupled to input pin P\$6 of the microcontroller 116, such that the trigger prep switch 104*c* is electrically coupled to input pin P\$6 of the microcontroller 116.

However, when the magazine 1400 is not retained in the magazine well, the trigger unit 104 is not electrically coupled to the magazine head connector 1410 and the magazine head connector 1410 is not electrically coupled to the microcontroller 116 (and the wireless communication module of the microcontroller 116), such that the trigger unit 104 is not electrically coupled to the microcontroller 116 (and the wireless communication module of the microcontroller 116). In particular, when the magazine 1400 is not retained in the magazine well, the trigger break switch 104*b* is not electrically coupled to input pin P\$5 of the microcontroller 116 and the trigger prep switch 104*c* is not electrically coupled to input pin P\$6 of the microcontroller 116.

Still referring to FIG. 16 (in conjunction with FIG. 15), the magazine head connector 1410 includes a third conductive contact 1420*c*. When the magazine 1400 is retained in the magazine well, an electrical ground is electrically coupled to the third conductive contact 1420*c* and the third conductive contact 1420*c* is electrically coupled to input pin P\$7 of the microcontroller 116, such that the electrical ground is electrically coupled to input pin P\$7 of the microcontroller 116. Conversely, when the magazine is not retained in the magazine well, the electrical ground is not electrically coupled to input pin P\$7 of the microcontroller 116. In such embodiments, the microcontroller 116 may determine that a magazine has been inserted into the magazine well based on a signal received by input pin P\$7 of the microcontroller 116 (e.g., determine that a magazine has been inserted when the signal is indicative of electrical ground), and determine that a magazine has been ejected from the magazine well based on based on the signal received by input pin P\$7 of the microcontroller 116 (e.g., determine that a magazine has been ejected when the signal is not indicative of an electrical ground).

Accordingly, it should be understood that in the embodiment of FIGS. 14-16, the electrical connection between the trigger unit 104 and the magazine sensor is interrupted when the magazine 1400 is ejected from the magazine well of the firearm frame 102 of the firearm simulator 1500. In some embodiments, the magazine head connector 1410 may include less than three or more than three conductive contacts, such that other combinations of electrical components may be put in electrical communication upon insertion of the magazine into the magazine well.

It should now be understood that embodiments described herein may provide feedback regarding the status of the firearm, as well as the accuracy, timing, and overall results of a shooter's performance. The firearm simulators described herein are easy to use and provide real time feedback, reporting, and simulation. The firearm simulators described herein are also inexpensive to implement. The firearm simulators described herein may be used with retroreflective targets that may be quickly and easily setup and taken down. The firearm simulators described herein may facilitate the use of targets in flexible arrangements covering multiple locations over a wide area and at varying distances. The firearm simulators described herein may be used in various lighting conditions. The firearm simulators described herein may be used with a computing device to report and output various shooting events and statistics.

The embodiments described herein may allow a user to perform dry fire exercises using a firearm simulator and receive immediate audible and visual feedback regarding accuracy, timing, and control. The embodiments described herein may simulate much of the aural feedback experienced when firing live ammunition at a shooting range or a competitive match, such as audible commands given by a Range Officer, the sound of gunshots as rounds are fired, and the sound of bullets hitting their targets, which are all configurable. The embodiments described herein may also simulate the functioning of an actual firearm by firing an optical pulse when the trigger is pulled, and by restricting the shooter to a fixed number of rounds per magazine allowing the shooter to include magazine change exercises into their training and practice scenarios. The embodiments described herein may also simulate a shot timer commonly used in training activities and shooting sports. Shots may be automatically timed such that the user can see cumulative and shot split times for successive strings in various courses of fire. The times it takes to perform magazine changes may also be measured and shown. Target hits and misses may be clearly indicated to provide the shooter with feedback on accuracy. The embodiments described herein may graphically plot the timing and accuracy results of shooting strings, thereby enabling the shooter to analyze details of shooting performance to more clearly identify where improvements can be made. The embodiments described herein provide a dry fire training experience with significantly enhanced simulations, adding feedback and realism to a much greater extent with a lower expense than found with existing firearm simulator training systems.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A firearm simulator comprising:

a processor;

a memory module communicatively coupled to the processor;

a trigger unit communicatively coupled to the processor, wherein the trigger unit outputs a trigger output signal;

an optoelectronic output device communicatively coupled to the processor, wherein the optoelectronic output device outputs light when activated;

an optoelectronic sensor communicatively coupled to the processor, wherein the optoelectronic sensor outputs an optoelectronic sensor output signal in response to sensed light; and machine readable instructions stored in the memory module that cause the firearm simulator to perform at least the following, when executed by the processor:

determine whether a trigger break event has occurred based on the trigger output signal;

determine whether a simulated round is available to be fired;

activate the optoelectronic output device when the trigger break event has occurred and the simulated round is available to be fired;

maintain the optoelectronic output device in a deactivated state when the trigger break event has occurred and the simulated round is not available to be fired;

determine an ambient light value based on the optoelectronic sensor output signal when the optoelectronic output device is in the deactivated state;

when the optoelectronic output device is activated such that the optoelectronic output device outputs light that is reflected off of a surface and sensed at the optoelectronic sensor as reflected light, determine a reflected light value based on the optoelectronic sensor output signal that is output in response to sensing the reflected light; and determine that a target hit event has occurred based on the reflected light value and the ambient light value.

2. The firearm simulator of claim 1, further comprising a round count stored in the memory module, wherein the machine readable instructions stored in the memory module further cause the firearm simulator to perform at least the following when executed by the processor:

determine that the simulated round is available to be fired when the round count is greater than zero; and determine that the simulated round is not available to be fired when the round count is less than one.

3. The firearm simulator of claim 1, further comprising a magazine sensor communicatively coupled to the processor, wherein the magazine sensor outputs a magazine sensor output signal, wherein the machine readable instructions stored in the memory module further cause the firearm simulator to perform at least the following when executed by the processor:

determine that a magazine insertion event has occurred based on the magazine sensor output signal;

after the magazine insertion event has occurred, determine that a subsequent trigger break event has occurred based on the trigger output signal; and activate the optoelectronic output device in response to the subsequent trigger break event.

4. The firearm simulator of claim 3, further comprising a round count stored in the memory module, wherein the machine readable instructions stored in the memory module further cause the firearm simulator to perform at least the following when executed by the processor:

modify the round count after the magazine insertion event has occurred.

5. The firearm simulator of claim 4, further comprising a wireless communication device communicatively coupled to the processor, wherein the machine readable instructions stored in the memory module further cause the firearm simulator to perform at least the following when executed by the processor:

transmit the round count to a computing device.

6. The firearm simulator of claim 1, further comprising:

a wireless communication device communicatively coupled to the processor, wherein the machine readable instructions stored in the memory module further cause the firearm simulator to perform at least the following when executed by the processor:

transmit the target hit event with the wireless communication device.

7. The firearm simulator of claim 1, wherein the machine readable instructions stored in the memory module further cause the firearm simulator to perform at least the following when executed by the processor:

determine a hit threshold value based on the ambient light value;

compare the reflected light value to the hit threshold value; and determine that the target hit event has occurred based on the comparison of the reflected light value and the hit threshold value.

8. The firearm simulator of claim 7, wherein the machine readable instructions stored in the memory module further cause the firearm simulator to perform at least the following when executed by the processor:

determine a time series of reflected light values based on the optoelectronic sensor output signal when the optoelectronic output device is activated;

calculate a running average reflected light value based on the time series of reflected light values;

compare the running average reflected light value with the hit threshold value; and determine that the target hit event has occurred based on the comparison of the running average reflected light value and the hit threshold value.

9. The firearm simulator of claim 7, wherein the machine readable instructions stored in the memory module further cause the firearm simulator to perform at least the following when executed by the processor:

determine the hit threshold value based on a light sensitivity setting stored in the memory module.

10. The firearm simulator of claim 1, wherein the machine readable instructions stored in the memory module further cause the firearm simulator to perform at least the following when executed by the processor:

determine a time series of reflected light values based on the optoelectronic sensor output signal when the optoelectronic output device is activated;

calculate a running average reflected light value based on the time series of reflected light values;

compare the running average reflected light value with the ambient light value; and determine that the target hit event has occurred based on the comparison of the running average reflected light value and the ambient light value.

11. The firearm simulator of claim 1, wherein the machine readable instructions stored in the memory module further cause the firearm simulator to perform at least the following when executed by the processor:

determine that a target miss event has occurred based on the reflected light value and the ambient light value; and transmit the target miss event with the wireless communication device.

12. A firearm simulator comprising:

a processor;

a memory module communicatively coupled to the processor;

a trigger unit communicatively coupled to the processor, wherein the trigger unit comprises:

a trigger;

a trigger prep switch that outputs a trigger prep output signal indicative of whether the trigger is in a trigger prep threshold position; and a trigger break switch that outputs a trigger break output signal indicative of whether the trigger is in a trigger break threshold position;

a wireless communication device communicatively coupled to the processor; and machine readable instructions stored in the memory module that cause the firearm simulator to perform at least the following, when executed by the processor:

determine whether a trigger prep event has occurred based on the trigger prep output signal of the trigger prep switch;

transmit the trigger prep event with the wireless communication device in response to determining that the trigger prep event has occurred;

determine whether a trigger break event has occurred based on the trigger break output signal of the trigger break switch; and transmit the trigger break event with the wireless communication device in response to determining that the trigger break event has occurred.

13. The firearm simulator of claim 12, wherein the machine readable instructions stored in the memory module further cause the firearm simulator to perform at least the following when executed by the processor:

determine whether a trigger release event has occurred based on a trigger output signal of the trigger unit; and transmit the trigger release event with the wireless communication device when the trigger release event is determined to have occurred.

14. A system comprising the firearm simulator of claim 12 and a computing device, wherein:

the machine readable instructions stored in the memory module of the firearm simulator cause the firearm simulator to perform at least the following, when executed by the processor of the firearm simulator:

transmit the trigger prep event with the wireless communication device of the firearm simulator to the computing device when the trigger prep event is determined to have occurred; and transmit the trigger break event with the wireless communication device of the firearm simulator to the computing device when the trigger break event is determined to have occurred;

the computing device comprises:

a second processor;

a second memory module communicatively coupled to the second processor;

a second wireless communication device communicatively coupled to the second processor;

a display; and second machine readable instructions stored in the second memory module that cause the computing device to perform at least the following, when executed by the second processor:

receive the trigger prep event with the second wireless communication device;

receive the trigger break event with the second wireless communication device; and output information pertaining to the trigger break event and the trigger prep event on the display.

15. The system of claim 14, wherein:

the firearm simulator further comprises a magazine sensor communicatively coupled to the processor of the firearm simulator, wherein the magazine sensor outputs a magazine sensor output signal;

the machine readable instructions stored in the memory module of the firearm simulator further cause the firearm simulator to perform at least the following when executed by the processor of the firearm simulator:

determine that a magazine insertion event has occurred based on the magazine sensor output signal;

transmit the magazine insertion event with the wireless communication device of the firearm simulator to the computing device when the magazine insertion event is determined to have occurred;

determine that a magazine ejection event has occurred based on the magazine sensor output signal;

transmit the magazine ejection event with the wireless communication device of the firearm simulator to the computing device when the magazine ejection event is determined to have occurred; and the second machine readable instructions stored in the second memory module further cause the computing device to perform at least the following when executed by the second processor:

receive the magazine insertion event with the second wireless communication device;

receive the magazine ejection event with the second wireless communication device; and output information pertaining to the magazine insertion event and the magazine ejection event on the display.

16. A firearm simulator comprising:

a magazine comprising a magnet and a magazine head connector;

a firearm frame comprising a magazine well for receiving the magazine and a magnetic field sensor positioned proximate the magazine well, wherein the magnetic field sensor outputs a magnetic field sensor output signal;

a microcontroller housed within the firearm frame;

a trigger unit housed within the firearm frame, wherein:

when the magazine is retained in the magazine well, the trigger unit is electrically coupled to the magazine head connector and the magazine head connector is electrically coupled to the microcontroller, such that the trigger unit is electrically coupled to the microcontroller; and when the magazine is not retained in the magazine well, the trigger unit is not electrically coupled to the microcontroller;

a processor;

a communication device communicatively coupled to the processor;

a memory module communicatively coupled to the processor; and machine readable instructions stored in the memory module that cause the firearm simulator to perform at least the following, when executed by the processor:

determine that the magazine has been inserted into the magazine well based on the magnetic field sensor output signal;

transmit a magazine insertion event with the communication device in response to determining that the magazine has been inserted into the magazine well;

determine that the magazine has been ejected from the magazine well based on the magnetic field sensor output signal; and transmit a magazine ejection event with the communication device in response to determining that the magazine has been ejected from the magazine well.

17. The firearm simulator of claim 16, wherein the communication device comprises a wireless communication device.

18. The firearm simulator of claim 16, wherein:

the magazine head connector includes a first conductive contact and a second conductive contact;

the trigger unit includes a trigger break switch and a trigger prep switch;

the microcontroller includes a first input pin and a second input pin;

when the magazine is retained in the magazine well, the trigger break switch is electrically coupled to the first conductive contact and the first conductive contact is electrically coupled to the first input pin of the microcontroller, such that the trigger break switch is electrically coupled to the first input pin of the microcontroller;

when the magazine is retained in the magazine well, the trigger prep switch is electrically coupled to the second conductive contact and the second conductive contact is electrically coupled to the second input pin of the microcontroller, such that the trigger prep switch is electrically coupled to the second input pin of the microcontroller;

when the magazine is not retained in the magazine well, the trigger break switch is not electrically coupled to the first input pin of the microcontroller; and when the magazine is not retained in the magazine well, the trigger prep switch is not electrically coupled to the second input pin of the microcontroller.

* * * * *